US009355605B2

(12) United States Patent
Wakabayashi et al.

(10) Patent No.: US 9,355,605 B2
(45) Date of Patent: May 31, 2016

(54) ELECTRO OPTICAL DEVICE INCLUDING CORRECTION UNIT THAT GENERATES CORRECTION DATA FOR IMAGE SIGNAL AND ELECTRONIC APPARATUS

(71) Applicant: Seiko Epson Corporation, Tokyo (JP)

(72) Inventors: Junichi Wakabayashi, Matsumoto (JP); Hidehito Iisaka, Shiojiri (JP); Hiroaki Ichimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 151 days.

(21) Appl. No.: 14/195,253

(22) Filed: Mar. 3, 2014

(65) Prior Publication Data

US 2014/0267213 A1 Sep. 18, 2014

(30) Foreign Application Priority Data

Mar. 13, 2013 (JP) ..... 2013-050099

(51) Int. Cl.
*G09G 3/36* (2006.01)

(52) U.S. Cl.
CPC ..... *G09G 3/3648* (2013.01); *G09G 3/3614* (2013.01); *G09G 3/3688* (2013.01); *G09G 2310/0248* (2013.01); *G09G 2320/0209* (2013.01); *G09G 2320/0285* (2013.01)

(58) Field of Classification Search
CPC ..... G09G 3/3275–3/3291; G09G 3/3659; G09G 3/3685–3/3692; G09G 2310/0272; G09G 2310/0297
See application file for complete search history.

(56) References Cited

U.S. PATENT DOCUMENTS

| | | | | |
|---|---|---|---|---|
| 5,798,740 | A | 8/1998 | Bitzakidis et al. | |
| 2001/0007537 | A1* | 7/2001 | Agawa | G11C 7/12 365/203 |
| 2002/0067324 | A1 | 6/2002 | Aoki | |
| 2007/0146281 | A1 | 6/2007 | Hosihara et al. | |
| 2009/0122035 | A1* | 5/2009 | Ito | G09G 3/2011 345/204 |
| 2010/0053145 | A1* | 3/2010 | Morita | G09G 3/3688 345/213 |
| 2010/0194718 | A1* | 8/2010 | Morita | G09G 3/3688 345/204 |
| 2010/0245397 | A1* | 9/2010 | Choe | G09G 3/342 345/690 |

FOREIGN PATENT DOCUMENTS

| | | | |
|---|---|---|---|
| JP | 2000-330093 | A | 11/2000 |
| JP | 2002-229530 | A | 8/2002 |
| JP | 2006-243267 | A | 9/2006 |
| JP | 3869464 | B | 1/2007 |
| JP | 4675646 | B | 4/2011 |
| JP | 4816031 | B | 11/2011 |
| WO | WO-96-16393 | A | 5/1996 |

* cited by examiner

*Primary Examiner* — Sanghyuk Park
(74) *Attorney, Agent, or Firm* — ALG Intellectual Property, LLC

(57) ABSTRACT

Vertical cross-talk is reduced. A correction circuit includes a correction amount calculation unit that calculates a correction amount on the basis of input image data Din and that generates correction amount data U; a correction coefficient generation unit that generates correction coefficient data C which represents a correction coefficient decided upon in accordance with a position in a horizontal scanning direction of a data line to which input image data Din to be corrected is supplied; and a correction unit that corrects the input image data Din on the basis of the correction amount data U and the correction coefficient data C and thereby generates correction image data Dh.

5 Claims, 17 Drawing Sheets

<MEMORY CONTENT OF FIRST MEMORY UNIT>

ODD-NUMBERED FIELD
EVEN-NUMBERED FIELD
P
Sx d11
d12
d13
d14
d15
d16
Vref
d11 - d21 d12
d13
d14
d15
d16
Vref
-d21
d12 - d22
-d21 d13
d14
d15
d16
Vref
-d21
-d22
d13 - d23
-d22 d14
d15
d16
Vref
-d21
-d22
-d23
d14 - d24
-d23 d15
d16
Vref
-d21
-d22
-d23
-d24
-d24

ELECTRO OPTICAL DEVICE INCLUDING CORRECTION UNIT THAT GENERATES CORRECTION DATA FOR IMAGE SIGNAL AND ELECTRONIC APPARATUS

BACKGROUND

1. Technical Field

The present invention relates to electro-optical devices and electronic apparatuses which display images.

2. Related Art

As an example of an electro-optical device including an electro-optical element whose optical property is changed by electric energy, a liquid crystal display device is known. A liquid crystal display device includes a plurality of data lines, a plurality of scanning lines, and pixel circuits provided at intersections of the data lines and the scanning lines. Each pixel circuit includes a selection transistor and a liquid crystal element, which is an electro-optical element. The selection transistor is controlled to be in an on state or an off state in accordance with a scanning signal supplied via the scanning line. When the selection transistor is in an on state, an image signal supplied via the data line is applied to the liquid crystal element; when the selection transistor is in an off state, a voltage of the image signal is held in the liquid crystal element. In other words, during a period from when the image signal is written into the pixel circuit to when the image signal is written thereinto next time, the voltage of the image signal which has been written is held in the liquid crystal element, whereby the liquid crystal element is controlled to have a transmittance corresponding to the voltage of the image signal. In an operation of an electro-optical device, a plurality of scanning lines are sequentially selected, and an image signal is written via a data line to a pixel circuit corresponding to the selected scanning line. Thus, the voltage of the data line changes every horizontal scanning period.

The data line is a capacitive load; therefore, a precharge voltage may be written into the data line before writing of the image signal. In other words, one horizontal scanning period may be divided into a precharge time in which the precharge voltage is supplied to the data line, and a write time in which the image signal is supplied to the data line.

Further, as a method for writing image signals into a plurality of data lines, a dot-sequential method and a phase-expansion method are known. In an electro-optical device employing a dot-sequential method, a plurality of switches are provided between one image signal line to which an image signal is supplied and a plurality of data lines; the switches are sequentially turned on exclusively, whereby the image signal is sampled and supplied to each data line. In an electro-optical device employing a phase-expansion method, a plurality of data lines are divided into blocks, and the image signal is supplied to the data lines per block. For example, in a phase-expansion method of six phases, one image signal is subjected to serial-parallel conversion into six phase image signals, and the image signals are supplied to six image signal lines. One block includes six data lines, and switches are provided between the data lines and the six image signal lines. Six switches in each block are turned on at the same time and the six phase image signals are written into the six data lines per block at the same time. In such a manner, in a dot-sequential method and a phase-expansion method, image signals are written a plurality of times during one horizontal scanning period.

The data line and the liquid crystal element are capacitively coupled via a parasitic capacitance. Therefore, if the voltages of data lines change in a period from when image signals are written into pixel circuits of a scanning line to when image signals are written thereinto next time, the voltages of the image signals held in the liquid crystal elements vary due to capacitive coupling. As a result, the display image quality is decreased. Specifically, in a liquid crystal display device, a polarity inversion driving method is employed where a polarity of the image signal is inverted about a reference level at a predetermined interval (e.g., at each field). In such a case, the voltages of the data lines greatly vary, which may cause so-called vertical cross-talk.

In order to reduce vertical cross-talk, a technique is known where image data for one field is stored in a large-capacity memory, and vertical cross-talk is corrected using the image data for one field stored in the memory (see, for example, JP-A-2000-330093 and Japanese Patent No. 3869464).

In addition, a technique is also known where, in a liquid crystal display device which displays the same image in a first field and a second field, two small-capacity memories are used, and vertical cross-talk is not corrected in the first field and is corrected only in the second field (see, for example, Japanese Patent No. 4816031).

However, in a dot-sequential method and a phase-expansion method, if a precharge voltage is written before writing of an image signal, a length of a period from writing of the precharge voltage to writing of the image signal differs with a position of the data line in a horizontal direction. In addition, since a leakage current flows through a switch between the image signal line and the data line when the switch is off, the voltage of the data line changes as time passes from writing of the precharge voltage to writing of the image signal. As a result, there has been a problem in that vertical cross-talk cannot be reduced sufficiently.

SUMMARY

An advantage of some aspects of the invention is that vertical cross-talk is reduced.

An electro-optical device according to an aspect of the invention including a plurality of data lines arranged in a first direction in which image signals are supplied to pixel circuits via the data lines, includes: a correction amount calculation unit that calculates a correction amount on the basis of input image data and generates correction amount data; a correction coefficient generation unit that generates correction coefficient data which represents a correction coefficient decided upon in accordance with positions of the data lines in the first direction to which the input image data to be corrected is supplied; a correction unit that generates correction data on the basis of the correction amount data and the correction coefficient data, corrects the input image data on the basis of the correction data, and generates correction image data; an image signal generation unit that generates an image signal on the basis of the correction image data; a plurality of switches that are provided at intersections of image signal lines to which the image signals are supplied and the data lines and that sample the image signals to be provided to the plurality of data lines; and a drive unit that supplies a precharge voltage to the plurality of data lines in a precharge time, and turns on the plurality of switches in a write time after the precharge time in a predetermined order.

According to this aspect of the invention, after the precharge voltage is supplied to the plurality of data lines, the plurality of switches are turned on in the write time in a predetermined order to provide the image signals to the data lines via the switches. In this case, due to an off-leakage current of each switch, a voltage of the data line changes from the precharge voltage. An amount of change in voltage of the data line depends on when the plurality of switches are turned on. Therefore, the correction coefficient is decided upon in accordance with a position of the data line in the first direction to which input image data to be corrected is supplied. Accordingly, the correction coefficient can be decided upon while taking an off-leakage characteristic of the switch into consideration. As a result, vertical cross-talk can be sufficiently reduced even when a voltage of the data line changes due to an off-leakage current of the switch.

In the above-described electro-optical device, it is preferable that the drive unit sequentially turn on the plurality of switches in the precharge time in one direction, and the correction coefficient generation unit generate the correction coefficient data so that a level of the correction coefficient data changes at a fixed rate in the direction. In such a case, a plurality of switches are sequentially turned on in the direction, and the correction coefficient changes at a fixed rate as selection of the switches proceeds in the first direction; thus, the correction coefficient corresponds to the amount of an off-leakage current of the switches. As a result, vertical cross-talk can be sufficiently reduced.

In the above-described electro-optical device, it is preferable that the correction coefficient generation unit generate the correction coefficient data so that a level of the correction coefficient data corresponds to a length of time from when the precharge time ends to when the switch is turned on. The amount of an off-leakage current of the switch depends on the length of an off-period thereof. According to the aspect of the invention, the correction coefficient data is generated in accordance with the length of the off period, whereby vertical cross-talk can be sufficiently reduced even when the voltage of the data line changes due to an off-leakage current of the switch.

In the above-described electro-optical device, it is preferable that the plurality of data lines be divided into a plurality of regions, and that the correction coefficient generation unit decide upon the correction coefficient data for each of the regions. In this case, the correction coefficient is decided upon for each of the plurality of regions, which allows the correction coefficients to be easily controlled.

Specifically, it is preferable that the number of the data lines in each region be the same, and the number of the data lines in each region is decided upon so that a difference between the correction coefficient data of one of the regions and the correction coefficient data of a region next to the region is a minimum resolution of the correction coefficient data. In this case where the number of the data lines in each region is decided upon so that a difference between neighboring regions is a minimum resolution of the correction coefficient data, vertical cross-talk can be corrected accurately.

In the above-described electro-optical device, it is preferable that the correction coefficient generation unit generate the correction coefficient in accordance with a change in a difference between a voltage of the image signal and the precharge voltage, during a period from when the precharge time ends to when the switch is turned on. A change in voltage of the data line is decided upon by a change in a difference between the voltage of the image signal and the precharge voltage; a correction coefficient can be decided upon taking the precharge voltage into consideration, and thus vertical cross-talk can be sufficiently corrected.

Further, an electronic apparatus according to another aspect of the invention preferably includes the above-described electro-optical device. Such an electronic apparatus is, for example, a projector, a personal computer, or a mobile phone.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
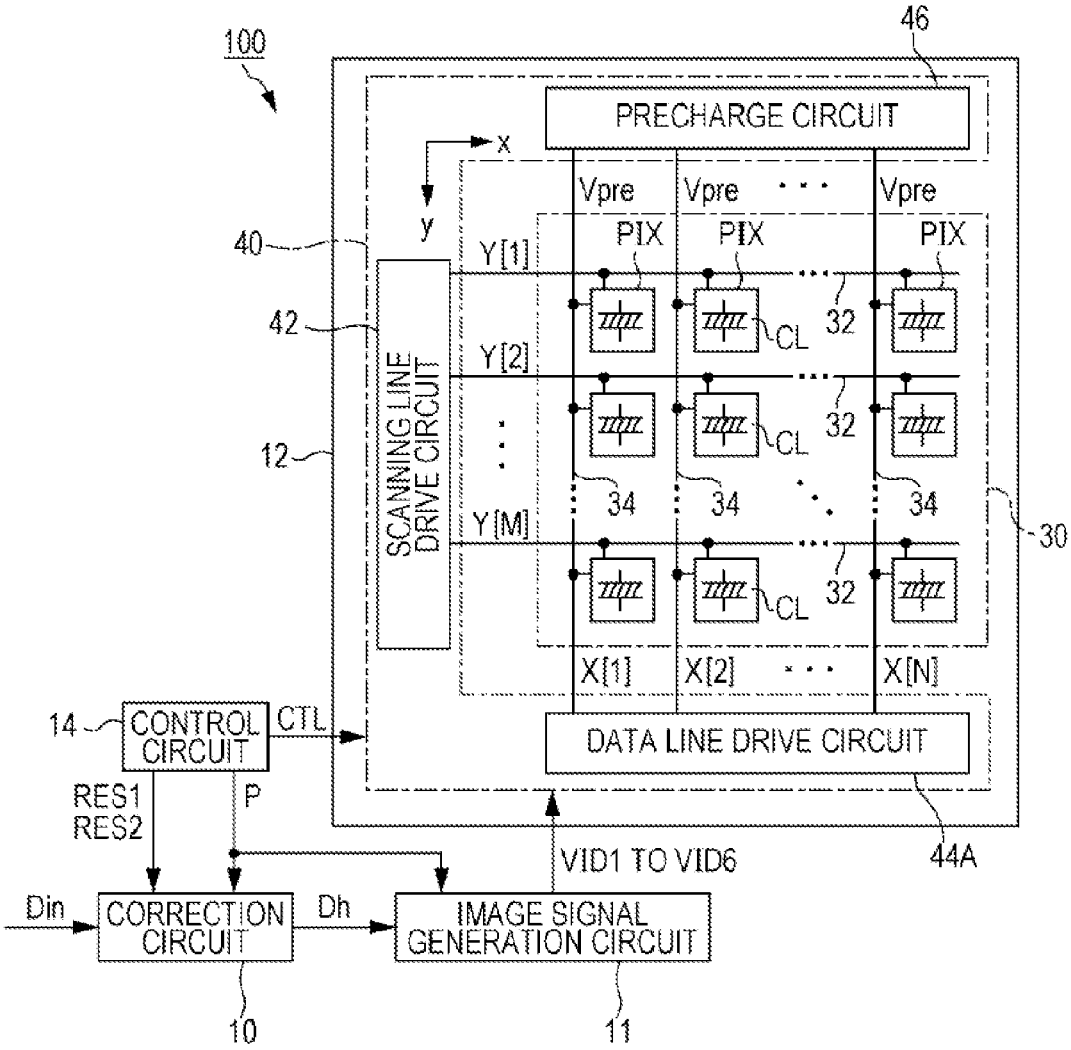
FIG. 1 is a block diagram of an electro-optical device according to a first embodiment of the invention.

FIG. 1 is a block diagram of an electro-optical device 100 according to a first embodiment of the invention. The electro-optical device 100 includes a correction circuit 10, an image signal generation circuit 11, an electro-optical panel 12, and a control circuit 14. The electro-optical panel 12 includes a display unit 30 in which a plurality of pixels (pixel circuits) PIX are arranged, and a drive circuit 40 which drives the pixels PIX. The display unit 30 includes M scanning lines 32 which extend in an x direction and N data lines 34 which extend in a y direction which intersects the x direction (M and N are natural numbers). The plurality of pixels PIX in the display unit 30 are arranged in matrix with M vertical columns and N horizontal rows, corresponding to intersections of the scanning lines 32 and the data lines 34.

Figure 2:
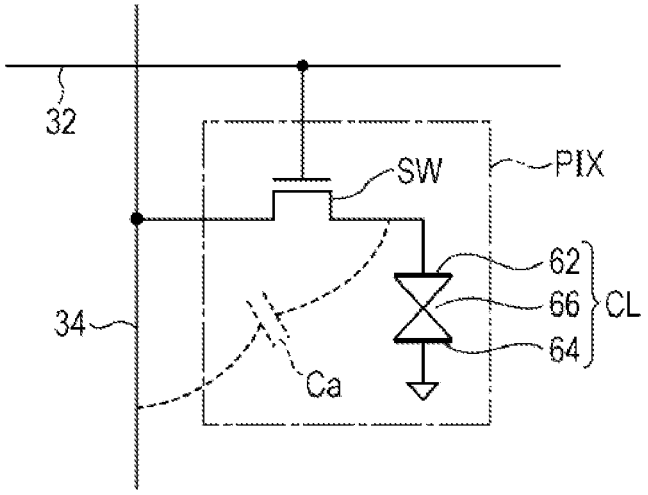
FIG. 2 is a circuit diagram of a pixel according to the embodiment.

FIG. 2 is a circuit diagram of the pixel PIX. As illustrated in FIG. 2, the pixel PIX includes a liquid crystal element CL and a selection switch SW. The liquid crystal element CL is an electro-optical element including a pixel electrode 62 and a common electrode 64 facing each other, and a liquid crystal 66 between the electrodes. A transmittance (a display gradation level) of the liquid crystal 66 changes in accordance with an applied voltage between the pixel electrode 62 and the common electrode 64. The selection switch SW includes an n-channel thin film transistor. A gate of the n-channel thin film transistor is connected to the scanning line 32. The selection switch SW is between the liquid crystal element CL and the data line 34 and controls an electrical connection therebetween, i.e., whether the liquid crystal element CL and the data line 34 are electrically connected or not. Note that an auxiliary capacitor may optionally be connected in parallel with the liquid crystal element CL.

The data line 34 and the liquid crystal element CL are capacitively coupled via a parasitic capacitance Ca. When a voltage of the data line 34 changes, a voltage applied to the liquid crystal element CL also changes.

The correction circuit 10 in FIG. 1 corrects input image data Din to reduce vertical cross-talk and thereby generates correction image data Dh. The control circuit 14 controls the entire electro-optical device 100. The control circuit 14 supplies various control signals CTL to the drive circuit 40 and also supplies a polarity signal P to the correction circuit 10 and the image signal generation circuit 11. In addition, the control circuit 14 generates a first reset pulse RES1 and a second reset pulse RES2 which reset the memory content of a first memory unit 112 and a second memory unit 122, which are described below.

In this embodiment, in order to prevent so-called ghosting, a polarity inversion driving method is employed in which a polarity of voltage applied to the liquid crystal element CL is inverted at a predetermined interval. In this example, a level of an image signal X applied to the pixel PIX via the data line 34 is inverted every unit period about a reference voltage Vref. The term "unit period" refers to a period of one unit of an operation for driving the pixel PIX. In this example, the unit period is equal to a field (a horizontal scanning period). Note that the unit period can be any period; for example, the unit period may be a natural multiple of the horizontal scanning period. The polarity signal P represents a polarity of the image signal X. In this example, when the polarity signal P is at a high level, the image signal X is positive and is higher than the reference voltage Vref; and when the polarity signal P is at a low level, the image signal X is negative and is lower than the reference voltage Vref.

The image signal generation circuit 11 performs DA conversion of the correction image data Dh, inverts the polarity of the image signal on the basis of the polarity signal P at the predetermined interval, and performs serial-parallel conversion of the image signal to generate image signals VID1 to VIDE expanded into six phases.

The drive circuit 40 supplies image signals X[n], which control display gradation levels of the pixels PIX, to the pixels PIX. The drive circuit 40 includes a scanning line drive circuit 42, a data line drive circuit 44A, and a precharge circuit 46. The scanning line drive circuit 42 sequentially selects the scanning lines 32 by providing scanning signals Y[1] to Y[M] to the scanning lines 32, respectively. When the scanning signal Y[m](m=1 to M) is at a predetermined selection potential (i.e., the scanning line 32 in the m-th row is selected), the selection switch SW in each pixel PIX in the m-th row is turned on at the same time.

In this embodiment, one horizontal scanning period is divided into a precharge time Tpre and a write time Tw. The precharge circuit 46 supplies a precharge voltage Vpre to all the data lines 34 in the precharge time Tpre. In the write time Tw, a connection terminal between the precharge circuit 46 and the data line 34 is in a high impedance state.

The data line drive circuit 44A supplies the image signals X[1] to X[N] respectively to the N data lines 34, in synchronization with selection of the scanning lines 32 by the scanning line drive circuit 42. The image signals X[1] to X[N] are obtained by sampling the image signals VID1 to VID6. The pixels PIX (the liquid crystal elements CL) display a gradation level corresponding to a potential of the image signal X[n](n=1 to N) supplied to the data line 34 when the scanning line 32 is selected (i.e., the selection switch SW is in an on state).

Figure 3:
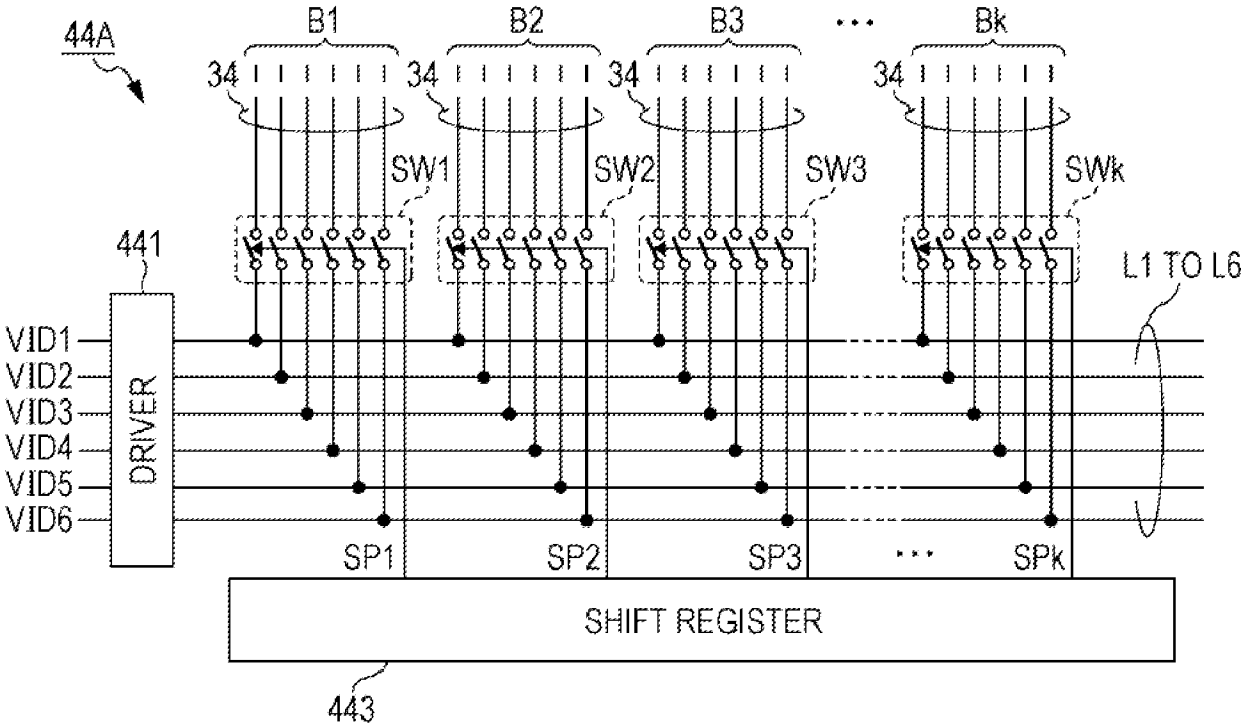
FIG. 3 is a block diagram of a data line drive circuit according to the embodiment.

FIG. 3 illustrates a configuration of the data line drive circuit 44A. The data line drive circuit 44A includes six image signal lines L1 to L6, a driver 441 which supplies the six-phase image signals VID1 to VID6 to the image signal lines L1 to L6, k (=N/6) switch circuits SW1 to SWk, and a shift register 443. In the following description, groups of six data lines 34 which correspond to the k switch circuits SW1 to SWk are referred to as blocks B1 to Bk.

Each of the switch circuits SW1 to SWk includes six switches each connected to the data line 34 and one of the image signal lines L1 to L6. The shift register 443 sequentially shifts a shift pulse supplied from the control circuit 14 in accordance with a clock signal and thus generates sampling pulses SP1 to SPk each of which is exclusively active in the write time Tw. The sampling pulses SP1 to SPk are supplied to the switch circuits SW1 to SWk, respectively. Thus, the image signals VID1 to VID6 are supplied to the data lines 34.

Figure 4:
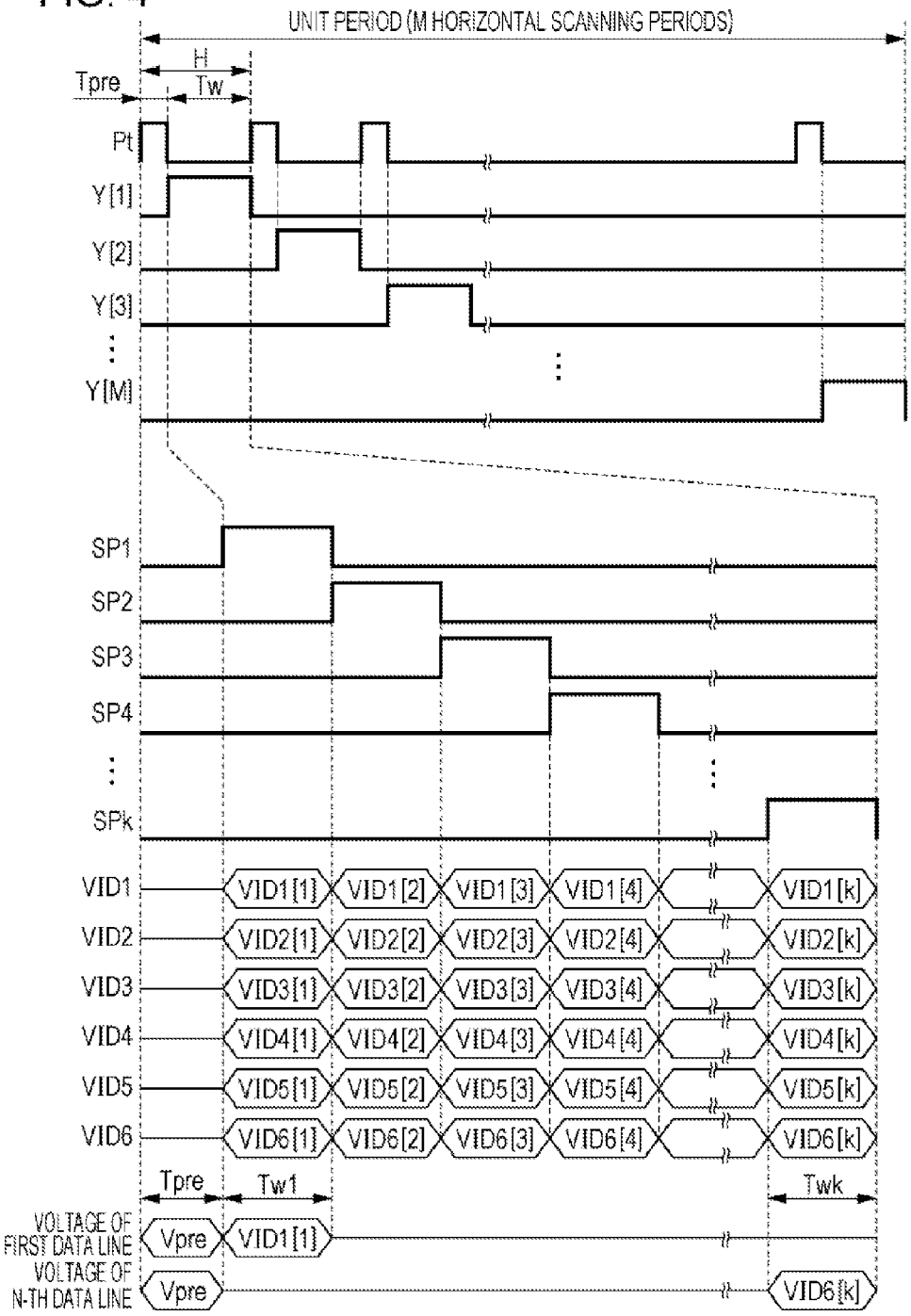
FIG. 4 is a timing chart, illustrating an operation of a drive circuit according to the embodiment.
Figure 5:
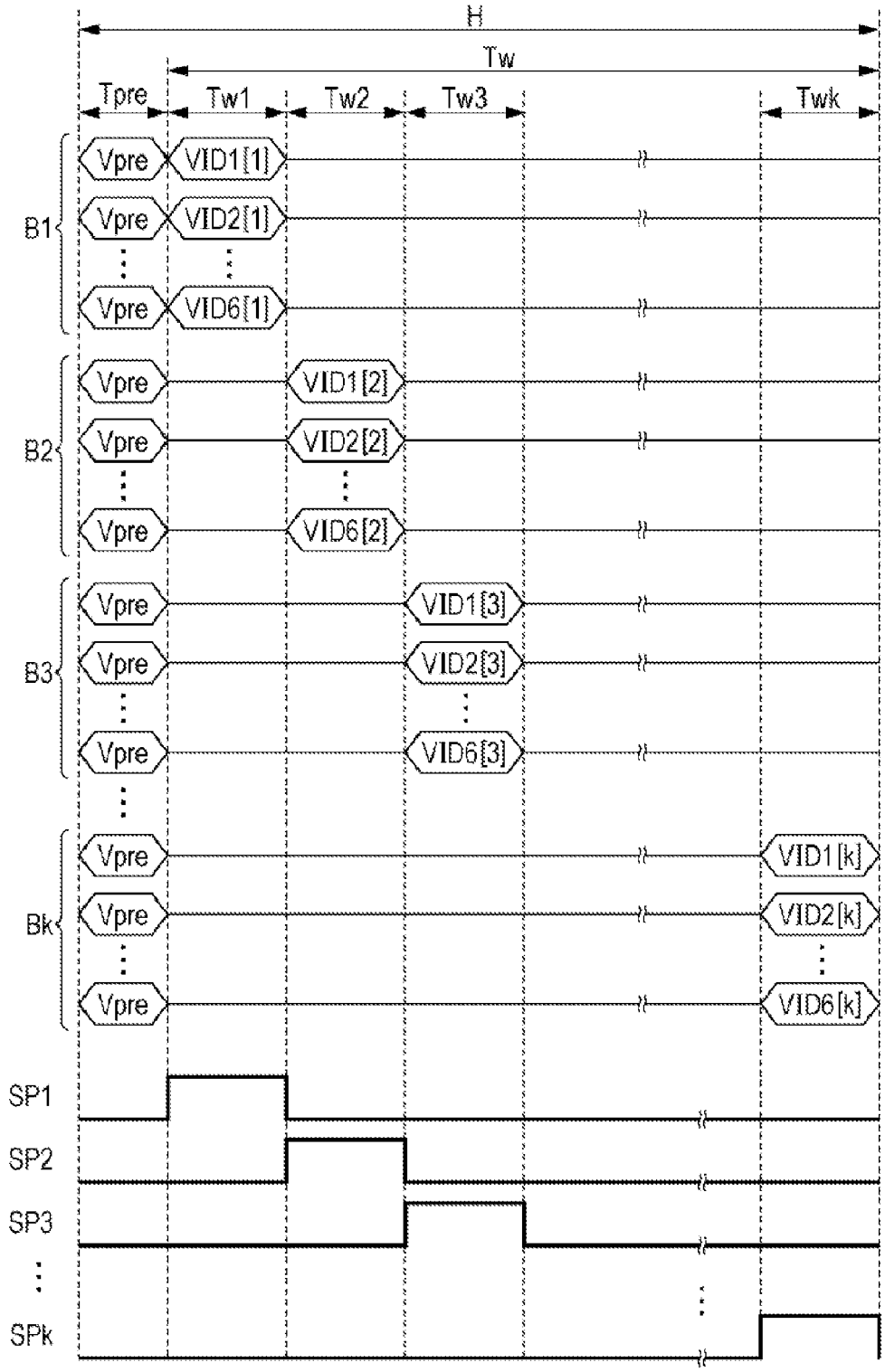
FIG. 5 is a timing chart, illustrating a relation between sampling pulses and voltage of data lines of blocks according to the embodiment.

FIG. 4 is a timing chart of the drive circuit 40. As illustrated in this chart, one unit period (in this example, a field) includes M horizontal scanning periods H. Each horizontal scanning period H includes the precharge time Tpre and the following write time Tw. A precharge timing signal Pt is at a high level during the precharge time Tpre and at a low level during the write time Tw. The precharge timing signal Pt is one of the control signals CTL. In the precharge time Tpre, the precharge voltage Vpre is supplied to all the data lines 34 from the precharge circuit 46. In the write time Tw, the k sampling pulses SP1 to SPk sequentially become active and the phase-expanded image signals VID1 to VID6 are sampled and supplied to the data lines 34. Thus, as illustrated in FIG. 5, in the block B1 which is the first from the left in the horizontal scanning direction, the voltage of the six data lines 34 is the precharge voltage Vpre in the precharge time Tpre, while the voltages are VID1[1], VID2[1], . . . VID6[1] in the write time Tw1 in which the sampling pulse SP1 is active. In the block B2 which is the second from the left, the voltages of the six data lines 34 are the precharge voltage Vpre in the precharge time Tpre, while the voltages are VID1[2], VID2[2], . . . VID6[2] in the write time Tw2 in which the sampling pulse SP2 is active. In such a manner, in the block Bk which is the kth from the left in the scanning line extending direction, the voltage of the six data lines 34 is the precharge voltage Vpre in the precharge time Tpre, while the voltages are VID1[*k*], VID2[*k*], . . . VID6[*k*] in the write time Twk in which the sampling pulse SPk is active.

Figure 6:
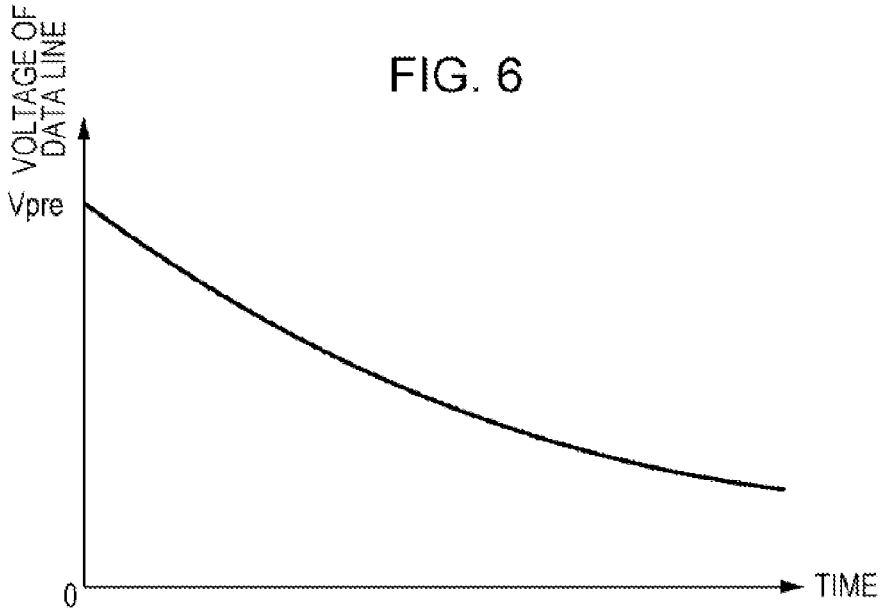
FIG. 6 illustrates an example of an off-leak characteristic.

As described above, in a phase expansion driving method, a length of time from when the precharge voltage Vpre is supplied to when the image signals VID1 to VIDE are supplied varies among the blocks B1 to Bk. In addition, a switch included in the switch circuits SW1 to SWk is a thin film transistor or the like and has a certain off-leak characteristic. FIG. 6 illustrates an example of an off-leak characteristic. In this example, the switch is on when the data line 34 is charged with the precharge voltage Vpre; at a time "0", the switch is turned off, a voltage of the image signal line to which the switch is connected is 0 V, and Vpre>0 V. An off-leakage current flows from the data line 34 to the image signal line through the switch. As a result, the voltage of the data line 34 gradually decreases with time.

The data lines 34 are aligned in the horizontal scanning direction. The length of an off period of the switch depends on the position of the data line 34 in the horizontal scanning direction. As the off period gets longer, the amount of leakage current from the data line 34 charged with the precharge voltage Vpre increases. An off resistance of a switch is ideally infinite. However, in recent years, the number of pixels in a panel and a drive frequency have tended to increase. This requires an increase in writing capacity by reducing an on-resistance of a switch. Writing capacity can be increased by increasing a gate width of a transistor in a switch, which results in a decrease in off resistance, causing an increase in a leakage current. Accordingly, a certain level of a leakage current needs to be accepted. Due to a leakage current, the voltages of data lines 34 just before writing of the image signals VID1 to VID6 vary with a length of time from when the precharge time Tpre ends to when the sampling pulses SP1 to SPk become active.

As described above, vertical cross-talk is generated because of capacitive coupling of the data line 34 and the liquid crystal element CL. When the voltages of the data lines 34 just before writing of the image signals VID1 to VID6 are different from the precharge voltage Vpre, the amount of voltage change in writing of the image signals VID1 to VID6 into the data lines 34 differs; thus, a degree of vertical cross-talk varies in the horizontal scanning direction.

Figure 7:
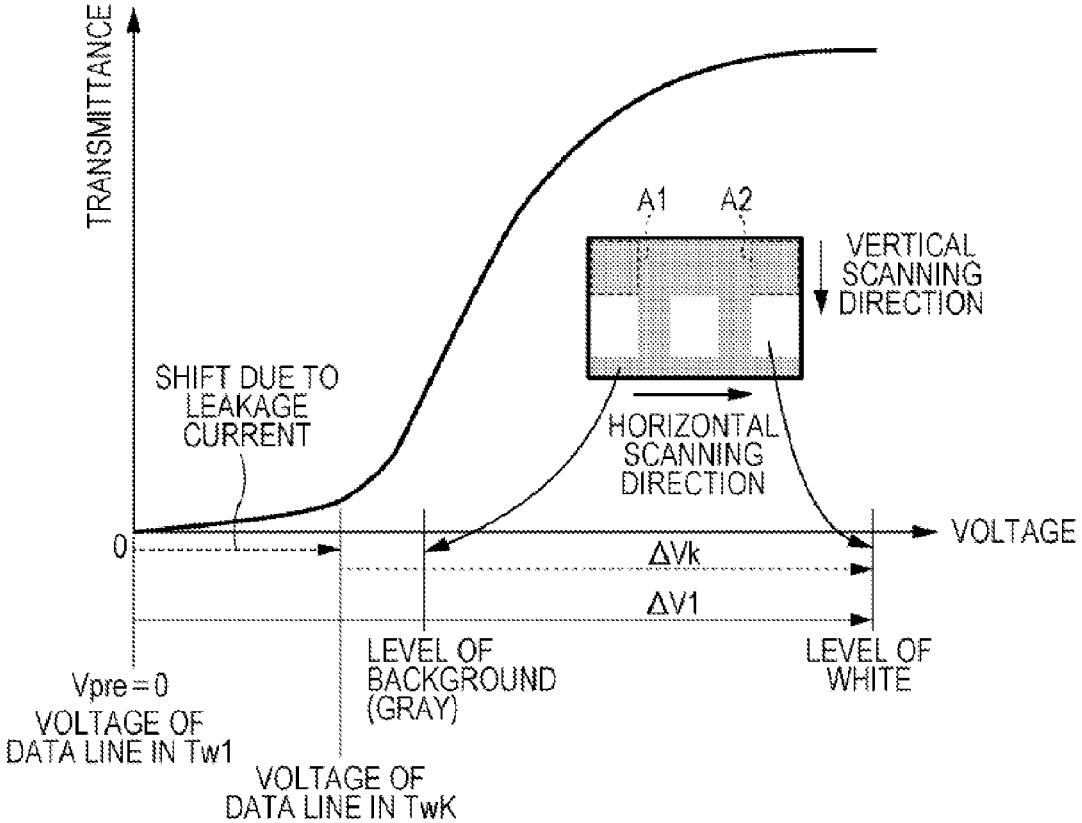
FIG. 7 illustrates an example of a relation between a transmittance characteristic of a liquid crystal element relative to applied voltage and a change in precharge voltage and data line voltage.

For example, there is a case where a transmittance characteristic of the liquid crystal element CL versus an applied voltage is illustrated in FIG. 7; an image with three white patterns on a gray background is to be displayed; and the precharge voltage Vpre is 0 V. In this case, the voltage of the data line 34 in the block B1 is the precharge voltage Vpre just before writing of the image signals VID1 to VID6 of the white level in the write time Tw1. The amount of change ΔV1 is needed to write the white level. On the other hand, the voltage of the data line 34 in the block Bk just before writing of the image signals VID1 to VID6 of the white level in the write time Twk has shifted toward a background level due to a leakage current of the switch. Thus, the amount of change needed for writing of the white level in the block Bk is Vk(<ΔV1), which is smaller than that of the block B1.

Here, the degree of vertical cross-talk in a region A1 and that in a region A2 are compared. As described above, compared to the block Bk (whose off period of the switch is long), the block B1 (whose off period of the switch is short) has a large change in voltage of the data line 34 when the white level is written. Thus, the applied voltage of the liquid crystal element CL, which is capacitively coupled with the data line 34, is greatly affected; accordingly, the degree of vertical cross-talk in the region A1 is greater than that in the region A2.

Figure 8:
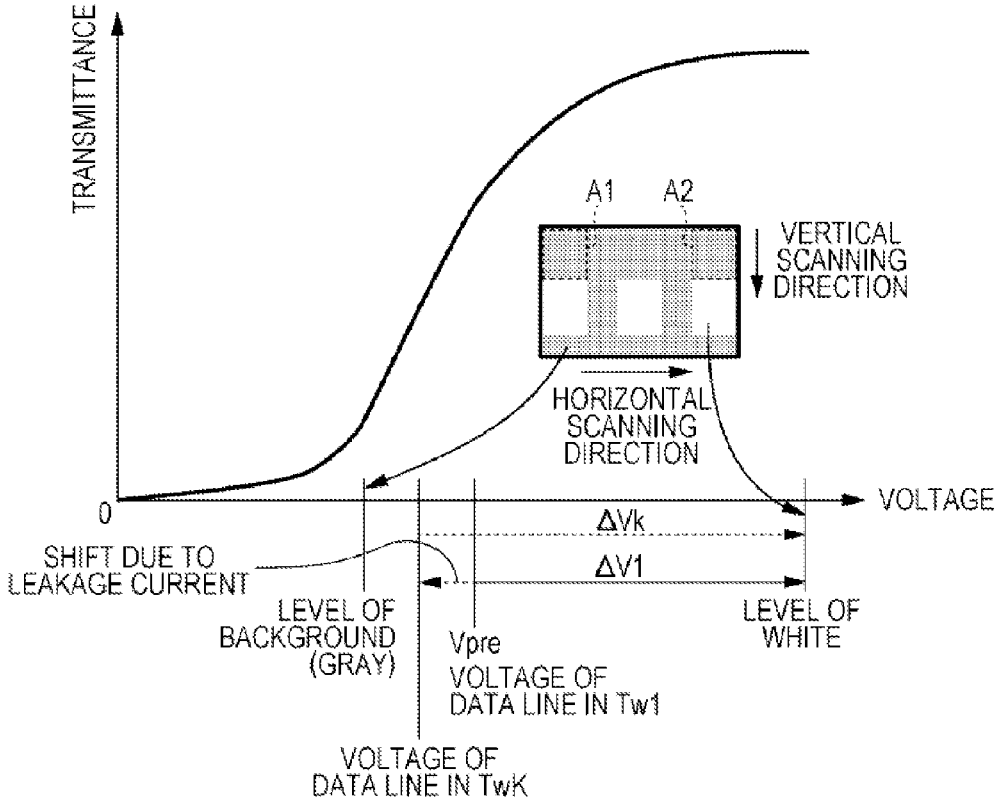
FIG. 8 illustrates another example of a relation between a transmittance characteristic of a liquid crystal element relative to applied voltage and a change in precharge voltage and data line voltage.

As another example, there is a case where a transmittance characteristic of the liquid crystal element CL versus an applied voltage is illustrated in FIG. 8; an image with three white patterns on a gray background is to be displayed; and the precharge voltage Vpre is higher than a voltage of the background level. In the block B1, the amount of change ΔV1 is needed to write the image signals VID1 to VID6 of the white level. On the other hand, in the block Bk, an amount of change ΔVk is needed to write the white level because the voltage of the data line 34 in the block Bk just before writing of the image signals VID1 to VID6 of the white level in the write time Twk has shifted toward the background level due to a leakage current of the switch. Thus, the amount of change ΔVk of the block Bk is larger than the amount of change ΔV1 of the block B1.

Here, the degree of vertical cross-talk in the region A1 and that in the region A2 are compared. Compared to the block B1 (whose off period of the switch is short), the block Bk (whose off period of the switch is long) has a large change in voltage of the data line 34 when the white level is written. Thus, the applied voltage of the liquid crystal element CL, which is capacitively coupled with the data line 34, is greatly affected; accordingly, the degree of vertical cross-talk in the region A2 is greater than that in the region A1.

As described so far, a degree of vertical cross-talk varies with a length of time for which a leakage current of the switch flows, which depends on the position of the switch in the horizontal scanning direction. Therefore, the correction circuit 10 in this embodiment decides upon a degree of vertical cross-talk correction in accordance with the length of time for which a leakage current of the switch flows (i.e., the position of the switch in the horizontal scanning direction).

Figure 9:
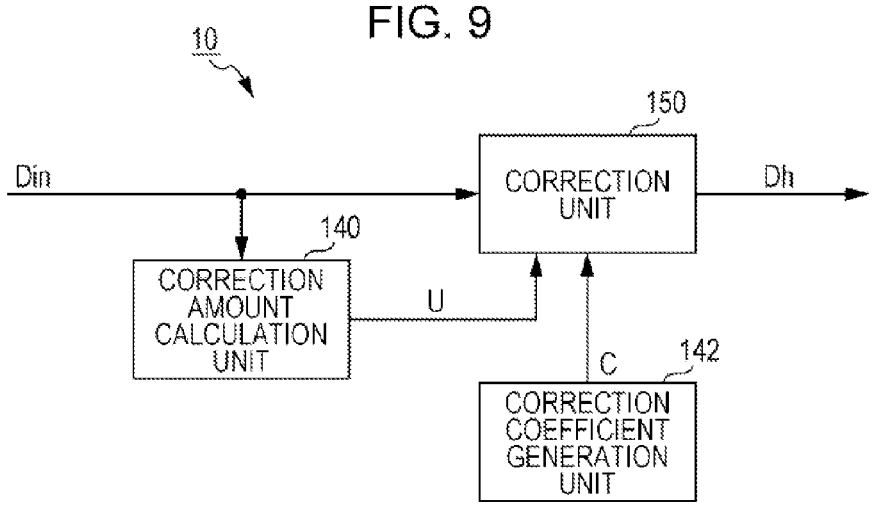
FIG. 9 is a block diagram of a correction circuit according to the embodiment.

FIG. 9 illustrates a configuration of the correction circuit 10. The correction circuit 10 includes a correction amount calculation unit 140, a correction coefficient generation unit 142, and a correction unit 150. The correction amount calculation unit 140 calculates a correction amount on the basis of the input image data Din to generate correction amount data U. The correction coefficient generation unit 142 generates correction coefficient data C which represents a correction coefficient decided upon in accordance with a position in the horizontal scanning direction of the data line 34 to which the input image data Din to be corrected is supplied. The correction unit 150 generates correction data on the basis of the correction amount data U and the correction coefficient data C, and corrects the input image data Din on the basis of the correction data to generate correction image data Dh. Specifically, the correction unit 150 multiplies the correction amount data U and the correction coefficient data C to generate the correction data.

Figure 10:
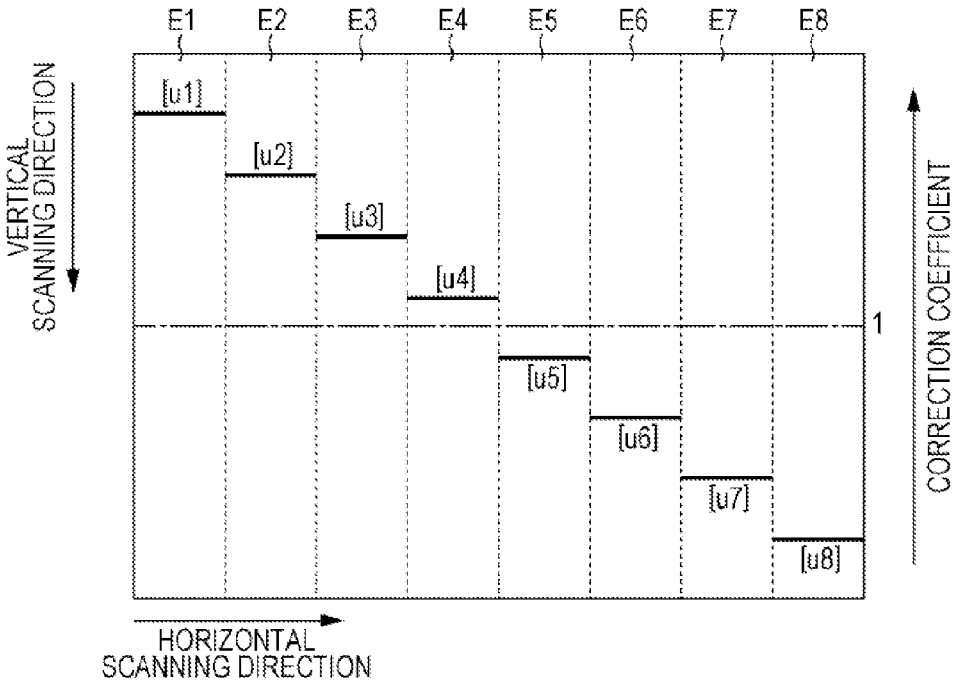
FIG. 10 illustrates an example of a relation between display regions and correction coefficients.

FIG. 10 illustrates an example of a relation between the correction coefficient and a display region. In this embodiment, the display unit 30 is divided into eight display regions E1 to E8 in the horizontal scanning direction. Correction coefficients u1 to u8 are applied to the display regions E1 to E8, respectively. In this example, the precharge voltage Vpre is 0 V, as illustrated in FIG. 7. The correction coefficients u1 to u8 satisfy the following formula: u1>u2>u3>u4>u5>u6>u7>u8.

The data line drive circuit 44A supplies the precharge voltage Vpre to the data line 34 in the precharge time Tpre, then turns on the switch circuits SW1 to SWk sequentially in the horizontal scanning direction in the write time Tw, while the correction coefficient generation unit 142 generates the correction coefficient data C in a manner such that the correction coefficient increases at a fixed rate as the selection of the switch circuits SW1 to SWk proceeds in the horizontal scanning direction. Thus, the correction coefficient generation unit 142 generates the correction coefficient data C to provide correction coefficients corresponding to the length of time from when the precharge time Tpre ends to when the switches in the switch circuits SW1 to SWk are turned on.

In an example of the related art, a correction coefficient for correction of vertical cross-talk is "1" for all the display regions E1 to E8 as indicated by a single-dot dash line in FIG. 10. Therefore, correction cannot be performed in accordance with an off-leak characteristic of a switch. According to this embodiment, on the other hand, the correction coefficient is changed with the length of off periods of switches; thus, vertical cross-talk can be more accurately reduced.

The correction amount calculation unit 140 may have any configuration as long as the correction amount data U representing a correction amount for the present input image data Din is generated on the basis of previous input image data Din. For example, the following three modes are given.

The correction amount calculation unit 140 according to a first mode includes a field memory. The field memory stores the input image data Din for one field. An integrated value of input image data Din of the previous field and the present field is calculated with reference to the memory content of the field memory, and the correction amount data U is generated on the basis of the calculated integrated value.

The correction amount calculation unit 140 according to a second mode includes a first line memory and a second line memory. The first line memory holds first integrated values of the input image data Din of the first field, which are accumulated for each column. The second line memory holds second integrated values which are accumulated for each column from the first row to the row before the row in which the data is to be written (or to the row in which the data is to be written) of the input image data Din of the second field. In the second field, the correction amount calculation unit 140 calculates an integrated value of the input image data Din from the previous field to the present field on the basis of the first integrated value and the second integrated value, and generates the correction amount data U on the basis of the calculated integrated value. The correction amount calculation unit 140 according to the second mode is usefully applied when a so-called double-speed drive system is employed where a same image is displayed both in the first field and the second field and vertical cross-talk is corrected in the second field.

Figure 11:
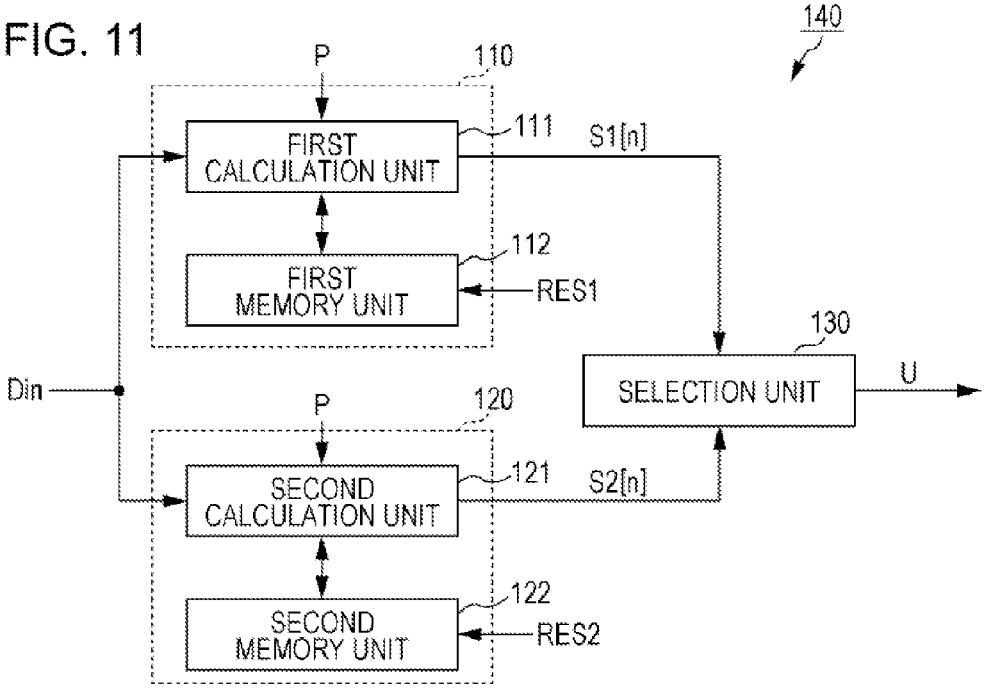
FIG. 11 is a block diagram of a correction amount calculation unit according to the embodiment.

Next, a configuration of the correction amount calculation unit 140 according to a third mode is illustrated in FIG. 11. The correction amount calculation unit 140 includes a first integration unit 110, a second integration unit 120, and a selection unit 130.

The first integration unit 110 integrates the input image data Din from a start of an odd-numbered field to an end of the following even-numbered field (see FIG. 12), and thereby generates first integrated data S1[*n*] of the even-numbered field which corresponds to an integrated value of a voltage of an image signal X[n](n=1 to N) applied to the data line 34 from the previous field to the present field. In addition, the polarity signal P is supplied to the first integration unit 110. The first integration unit 110 performs either addition or subtraction of the input image data Din according to the polarity of the image signal X[n] represented by the polarity signal P to generate the first integrated data S1[*n*].

Specifically, the first integration unit 110 includes a first calculation unit 111 and the first memory unit 112. The first memory unit 112 stores the N first integrated data S1[*n*] (n=1 to N) corresponding to the N data lines 34. The first calculation unit 111 integrates the input image data Din using the first memory unit 112 to generate the N first integrated data S1[*n*] (n=1 to N). The memory content of the first memory unit 112 is reset by a first reset pulse RES1 which becomes active just before an odd-numbered field starts.

The second integration unit 120 integrates the input image data Din from the start of an even-numbered field to the end of the following odd-numbered field, and thereby generates second integrated data S2[*n*] in the odd-numbered field which corresponds to an integrated value of the voltage of the image signal X[n] applied to the data line 34 from the previous field to the present field. In addition, the polarity signal P is supplied to the second integration unit 120. The second integration unit 120 performs either addition or subtraction of the input image data Din in accordance with the polarity of the image signal X[n] represented by the polarity signal P to generate the second integrated data S2[*n*].

Specifically, the second integration unit 120 includes a second calculation unit 121 and the second memory unit 122. The second memory unit 122 stores the N second integrated data S2[*n*] (n=1 to N) corresponding to the N data lines 34. The second calculation unit 121 integrates the input image data Din using the second memory unit 122 to generate the N second integrated data S2[*n*] (n=1 to N). The memory content of the second memory unit 122 is reset by a second reset pulse RES2 which becomes active just before an even-numbered field starts.

The selection unit 130 selects the first integrated data S1[*n*] in the even-numbered field and the second integrated data S2[*n*] in the odd-numbered field to generate the correction amount data U.

Figure 12:
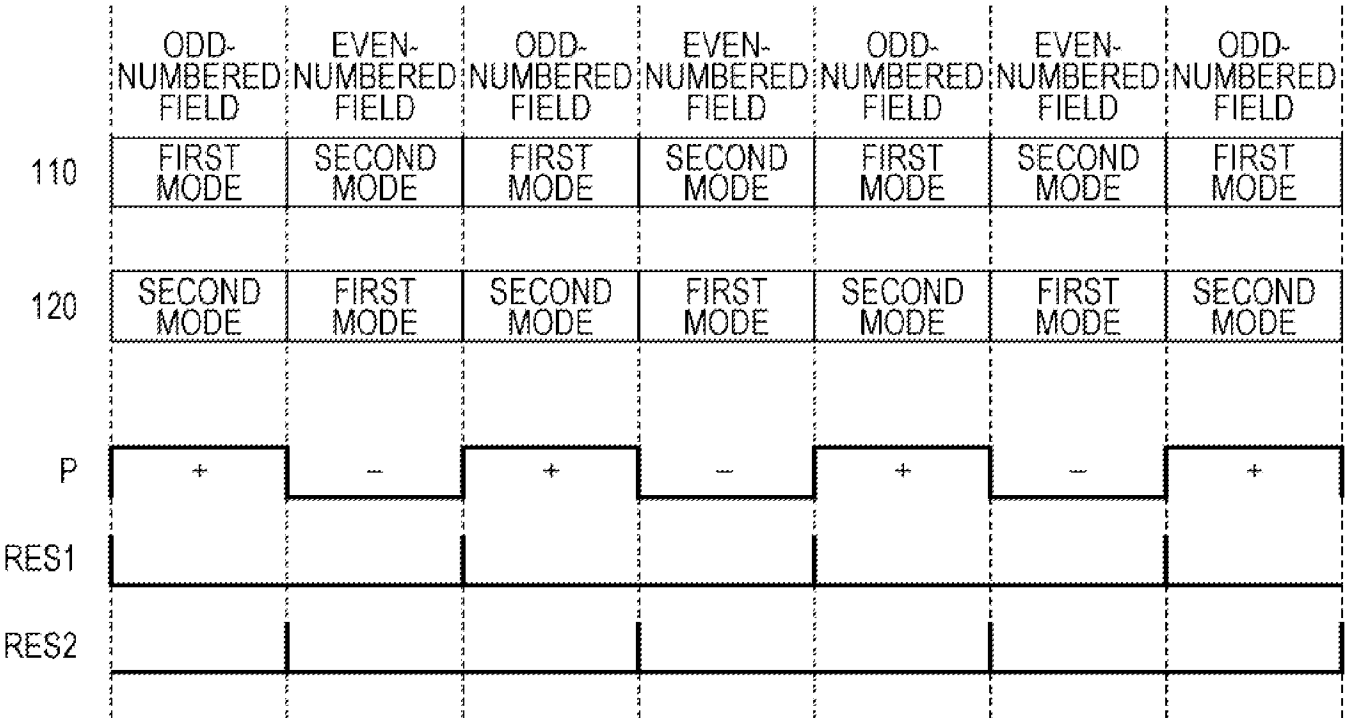
FIG. 12 is a timing chart illustrating an operation of a correction circuit according to the embodiment.

FIG. 12 is a timing chart illustrating an operation of the correction amount calculation unit 140. As illustrated in FIG. 12, the first integration unit 110 operates in a first mode in the odd-numbered fields and in a second mode in the even-numbered fields. The second integration unit 120 operates in a first mode in the even-numbered fields and in a second mode in the odd-numbered fields. In the first mode, when the polarity of the polarity signal P is positive, the input image data Din is integrated as it is and when the polarity of the polarity signal P is negative, the input image data Din is multiplied by "−1", and is then integrated. In this example, a field inversion driving method is employed in which the polarity is inverted every field; the polarity of the polarity signal P is positive (+) in the odd-numbered field, and is negative (−) in the even-numbered field. Accordingly, the first integration unit 110 integrates the input image data Din as it is in the odd-numbered fields, while the second integration unit 120 multiplies the input image data Din by "−1" and then integrates the input image data Din in the odd-numbered fields.

In this example, the number M of the scanning lines 32 is "6", and the number of data lines 34 is N. In addition, the input image data Din corresponding to the image signal X[*n*] supplied to the n-th data line 34 in an odd-numbered field is d11 to d16; the input image data Din corresponding to the image signal X[*n*] supplied to the n-th data line 34 in the following even-numbered field is d21 to d26; and the input image data Din corresponding to the image signal X[*n*] supplied to the n-th data line 34 in the following odd-numbered field is d31 to d36.

Figure 13:
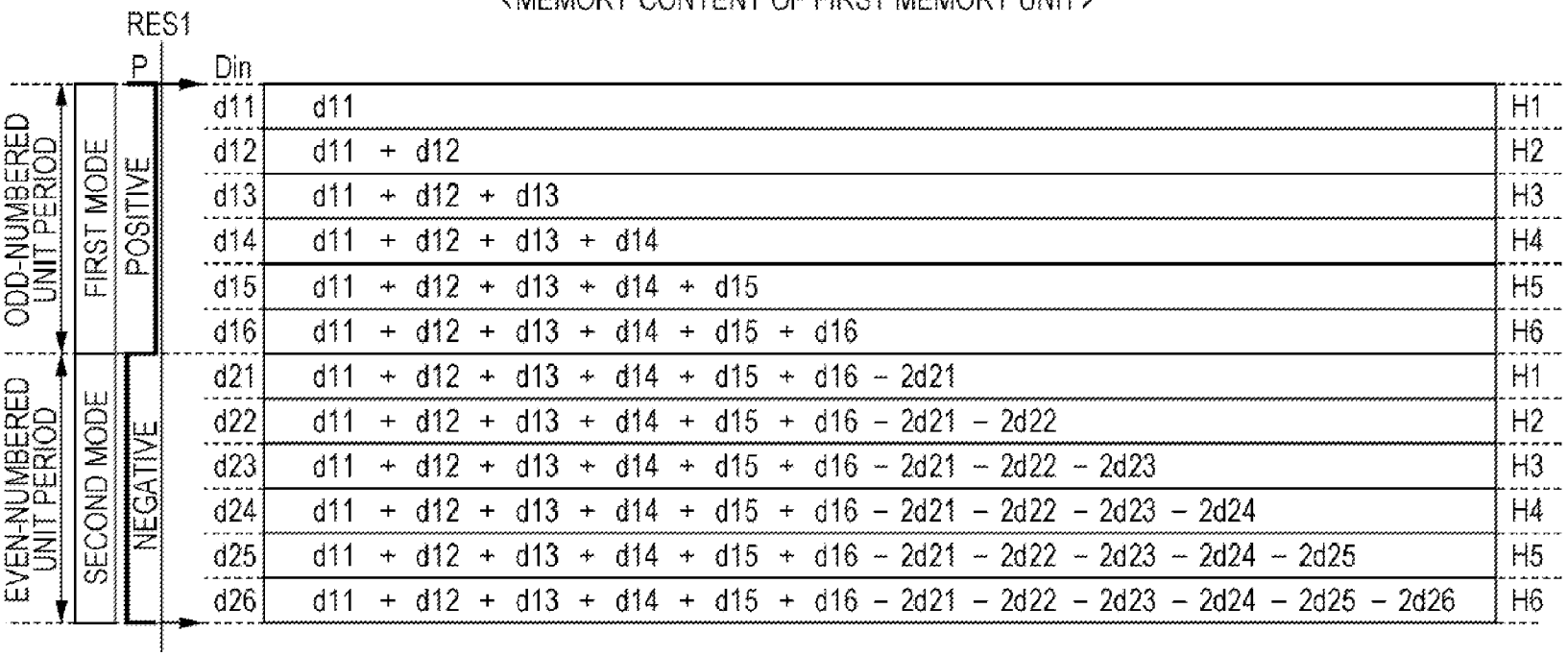
FIG. 13 illustrates a change of a memory content in a first memory unit according to the embodiment.

FIG. 13 illustrates the memory content of the first memory unit 112. In the odd-numbered field, the first calculation unit 111 operates in the first mode. In this case, the first calculation unit 111 updates the memory content of the first memory unit 112 by writing data thereto obtained by adding the present input image data Din and data read out from the first memory unit 112. First, the memory content of the first memory unit 112 is reset just before the odd-numbered field. Then, when the data value d11 is supplied as the input image data Din, the first calculation unit 111 reads out data from the first memory unit 112. The value of the data read out is "0". The first calculation unit 111 integrates (here, adds) this data and the data value d11, and updates the memory content of the first memory unit 112 to be "d11". Then, when the data value d12 is supplied as the input image data Din, the first calculation unit 111 reads out the data value d11 from the first memory unit 112, integrates (here, adds) this data and the data value d12, and updates the memory content of the first memory unit 112 to be "d11+d12 ". The integration is then repeated, whereby a data value "d11+d12+d13+d14+d15+d16" is stored in the first memory unit 112 when the odd-numbered field ends. In other words, when the odd-numbered field ends, in the first memory unit 112, the first integrated data S1[*n*] which corresponds to the integrated value of the voltage of the image signal X[*n*] supplied to the n-th data line 34 from the previous field to the present field is stored.

In the even-numbered field, the first calculation unit 111 operates in the second mode. In this case, the first calculation unit 111 updates the memory content of the first memory unit 112 by writing new first integrated data S1[*n*] thereto which is obtained by subtracting twice the present input image data Din from the first integrated data S1[*n*] read out from the first memory unit 112. As illustrated in FIG. 12, when the even-numbered field starts and the data value d21 which is the present input image data Din is supplied, the first calculation unit 111 writes the first integrated data S1[*n*] which is obtained by subtracting "2d22" from the first integrated data S1[*n*]=d11+d12+d13+d14+d15+d16 read out from the first memory unit 112, into the first memory unit 112. Thus, the memory content of the first memory unit 112 is updated to be "d11+d12+d13+d14+d15+d16−2d21". Then, when the data value d22 is supplied as the input image data Din, the first calculation unit 111 reads out the data value "d11+d12+d13+d14+d15+d16−2d21" from the first memory unit 112, subtracts 2d22 therefrom, and updates the memory content of the first memory unit 112 to be "d11+d12+d13+d14+d15+d16−2d21−2d22". A similar calculation is then repeated and thus the first calculation unit 111 generates the first integrated data S1[*n*] in the even-numbered field.

Figure 14:
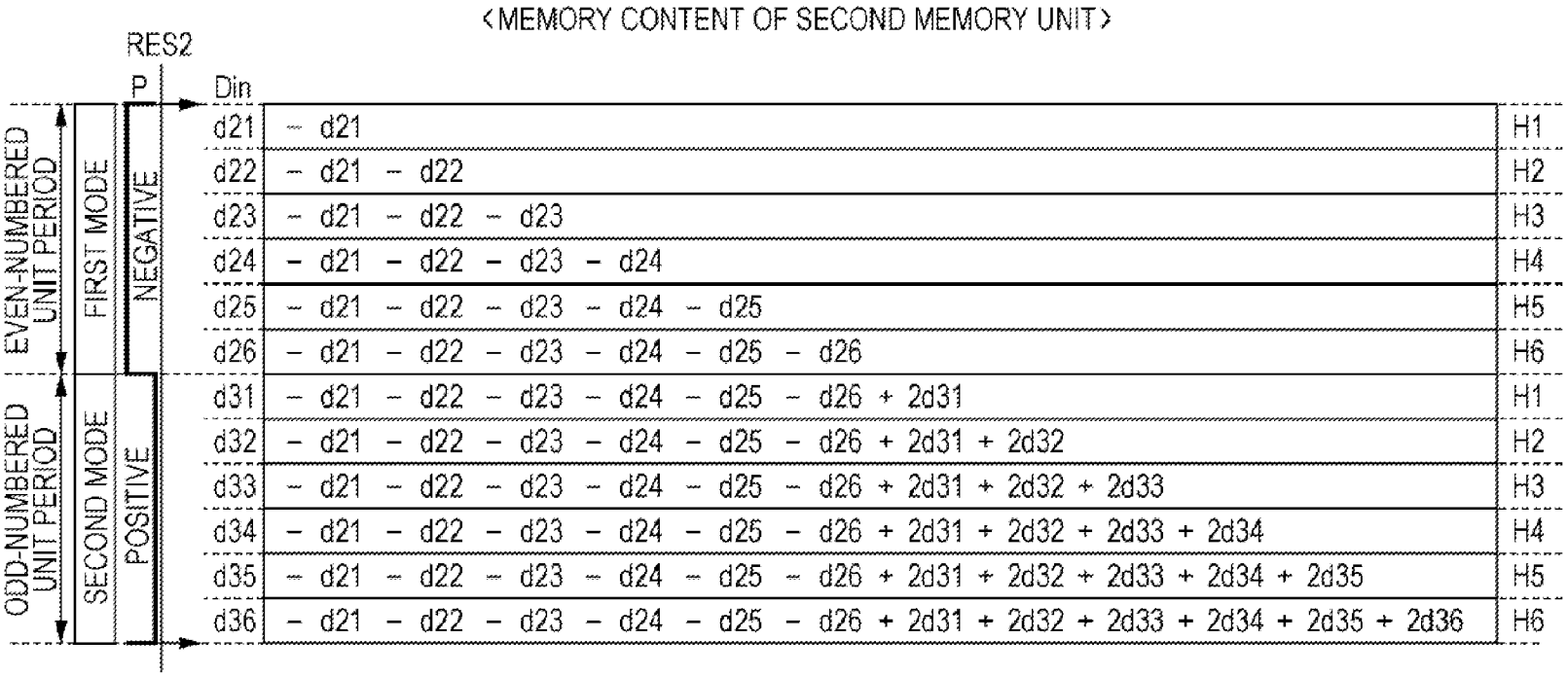
FIG. 14 illustrates a change of a memory content in a second memory unit according to the embodiment.

FIG. 14 illustrates the memory content of the second memory unit 122. In the even-numbered field, the second calculation unit 121 operates in the first mode. In this case, the second calculation unit 121 updates the memory content of the second memory unit 122 by writing thereto data obtained by adding a result of multiplication of the present input image data Din and "−1", and data read out from the second memory unit 122. First, the memory content of the second memory unit 122 is reset just before the even-numbered field. Then, when the data value d21 is supplied as the input image data Din, the second calculation unit 121 reads out data from the second memory unit 122. The value of the data read out is "0". In the even-numbered field, since the polarity signal P represents a negative polarity, the second calculation unit 121 integrates the data value "0", which is read out, and "−d21 ", which is a result of multiplication of the data value "d21" of the input image data Din and "−1" (here, the integration refers to subtraction of d21 from 0); and the memory content of the second memory unit 122 is updated to be "−d21". Then, when the data value d22 is supplied as the input image data Din, the second calculation unit 121 reads out the data value −d21 from the second memory unit 122, integrates the data value −d21 and the data value −d22 (here, subtracts the data value d22 from the data value −d21 ), and updates the memory content of the second memory unit 122 to be "−d21−d22 ". The integration is then repeated, whereby a data value "−d21−d22−d23−d24−d25−d26" is stored in the second memory unit 122, when the even-numbered field ends. In other words, when the even-numbered field ends, in the second memory unit 122, the second integrated data S2[*n*] which corresponds to the integrated value of the voltage of the image signal X[*n*] supplied to the n-th data line 34 from the previous field to the present field is stored.

In the odd-numbered field, the second calculation unit 121 operates in the second mode. In this case, the second calculation unit 121 updates the memory content of the second memory unit 122 by writing new second integrated data S2[*n*] thereto which is obtained by adding twice the present input image data Din to the second integrated data S2[*n*] read out from the second memory unit 122. When the odd-numbered field starts and the data value d31 , which is the present input image data Din is supplied, the second calculation unit 121 writes the second integrated data S2[*n*], which is obtained by adding "2d31" to the second integrated data S2[*n*]=−d21−d22−d23−d24−d25−d26 read out from the second memory unit 122, into the second memory unit 122. Thus, the memory content of the second memory unit 122 is updated to be "−d21−d22−d23−d24−d25−d26+2d31". Then, when the data value d32 is supplied as the input image data Din, the second calculation unit 121 reads out data value "−d21−d22−d23−d24−d25−d26+2d31" from the second memory unit 122, subtracts 2d32 therefrom, and updates the memory content of the second memory unit 122 to be "−d21−d22−d23−d24−d25−d26+2d31+2d32". A similar calculation is then repeated and thus the second calculation unit 121 generates the second integrated data S2[*n*] in the odd-numbered field.

FIGS. 15A to 15E illustrate the first integrated data S1[*n*] generated in an even-numbered field. A waveform in FIG. 15 illustrates the image signal X[*n*]. When an odd-numbered field ends, the first integrated data S1[*n*] has a value which corresponds to a shaded area Sx in FIG. 15A. Then, in a first horizontal scanning period in the even-numbered field, a shaded area in FIG. 15B corresponds to an integrated value of the voltage of the image signal X[*n*] supplied to the n-th data line 34 from the previous field to the present. That is, an area corresponding to the data value d11 needs to be removed and an area corresponding to the data value d21 needs to be subtracted from the area SX of the end of the odd-numbered field. The input image data Din generally has a high field correlation and thus the data value d11 is substantially equal to the data value d21. Accordingly, by subtracting the data value d21 from the first integrated data S1[*n*](=d11+d12+d13+d14+d15+d16 ), an area of a part which is higher than the reference voltage Vref can be obtained. In the even-numbered field, since the polarity signal P is at a low level and has a negative polarity, by subtracting the data value d21, the first integrated data S1[*n*] (=d11+d12+d13+d14+d15+d16−2d12 ) is obtained, which is an integrated valve of the voltage of the image signal X[*n*] from the previous field to the present using the reference voltage Vref as a center level. With the new first integrated data S1[*n*] thus obtained, the memory content of the first memory unit 112 is updated. In such a manner, in the first horizontal scanning period H1 in the even-numbered field, the memory content of the first memory unit 112 is updated as illustrated in FIG. 13.

Figures 15A, 15B, 15C, 15D, 15E:
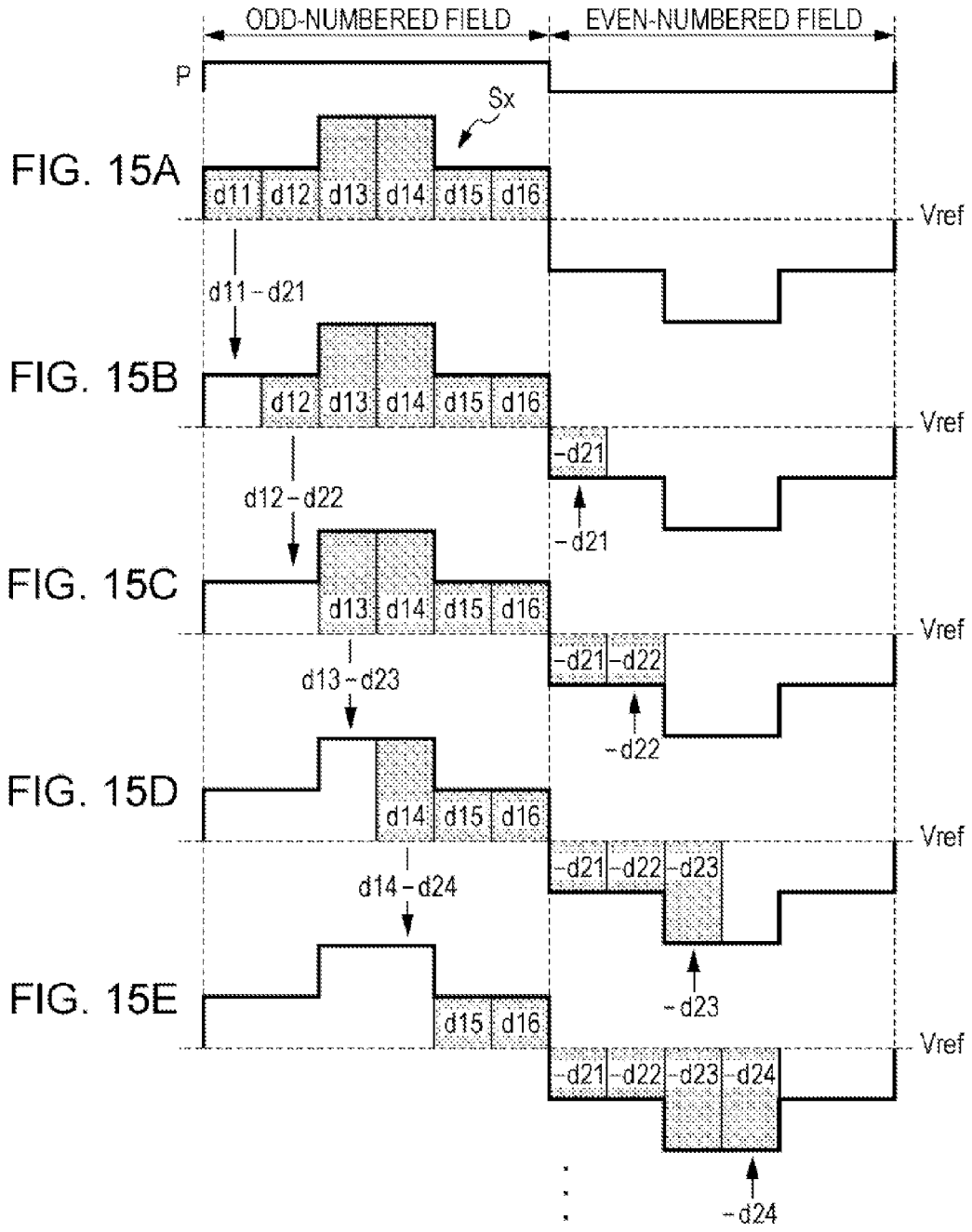
FIGS. 15A to 15E illustrate a change of first integrated data generated in an even-numbered unit period.

Then, in the second horizontal scanning period H2 in the even-numbered field, as illustrated in FIG. 15C, the data value d22 which is substantially equal to the data value d12 is subtracted, and the data value d22 is further subtracted for a voltage lower than the reference voltage Vref; whereby the first integrated data S1[*n*] is generated. Thus, in the second horizontal scanning period H2 in the even-numbered field, the memory content of the first memory unit 112 is updated to be "d11+d12+d13+d14+d15+d16−2d12−2d22", as illustrated in FIG. 13.

In such a manner, the memory content of the first memory unit 112 is updated as illustrated in FIG. 13. The first integrated data S1[$n$] is generated, as illustrated in FIG. 15D and FIG. 15E in the third horizontal scanning period H3 and the fourth horizontal scanning period H4 in the even-numbered field, respectively.

As described above, in the first mode, the first calculation unit 111 integrates the input image data Din using the first memory unit 112 to generate the first integrated data S1[$n$] for one field; while in the second mode, the first calculation unit 111 updates the memory content of the first memory unit 112 using the first integrated data S1[$n$] generated in the first mode and the present input image data Din so that an area of the integration shifts in each horizontal scanning period. Therefore, a large-capacity field memory is not needed and a memory capacity of the first memory unit 112 can be greatly decreased. In addition, a memory capacity of the second memory unit 122 can be greatly decreased for the same reason. Note that in this embodiment, a field memory may be used.

By providing the first integration unit 110 and the second integration unit 120, correction for reducing vertical cross-talk can be performed both in the odd-numbered fields and the even-numbered fields. That is, even when the resulting device does not employ a double-speed drive system or is not used for displaying still images, vertical cross-talk can be corrected using the first memory unit 112 and the second memory unit 122 having small memory capacity. In addition, the memory content of the first memory unit 112 is reset just before the odd-numbered field, and the memory content of the second memory unit 122 is reset just before the even-numbered field; whereby even if an area exists where vertical cross-talk is not sufficiently reduced in displaying moving images, an effect thereof is not given to the following field. Accordingly, vertical cross-talk can be reduced efficiently not only in the case where the same image is written during a plurality of fields such as the cases where still images are displayed or a double-speed drive system is employed, but also in the case where images change every field.

Second Embodiment

In the electro-optical device 100 according to the first embodiment, the data line drive circuit 44A sequentially selects blocks in the following order in the horizontal scanning direction: B1, B2, B3, . . . Bk, and supplies the phase-expanded image signals VID1 to VIDE to the data lines 34. The electro-optical device 100 according to the second embodiment differs in that the blocks B1 to Bk are sequentially selected from the blocks B1 and Bk, which are at the left-end and right-end, respectively, toward the center.

The electro-optical device 100 according to the second embodiment has a similar configuration to the electro-optical device 100 according to the first embodiment illustrated in FIG. 1, except that a data line drive circuit 44B is used instead of the data line drive circuit 44A; the image signal generation circuit 11 generates image signals vid1 to vid6 in addition to the phase-expanded image signals VID1 to VID6 and supplies those signals to the data line drive circuit 44B; and an operation of the correction coefficient generation unit 142.

Figure 16:
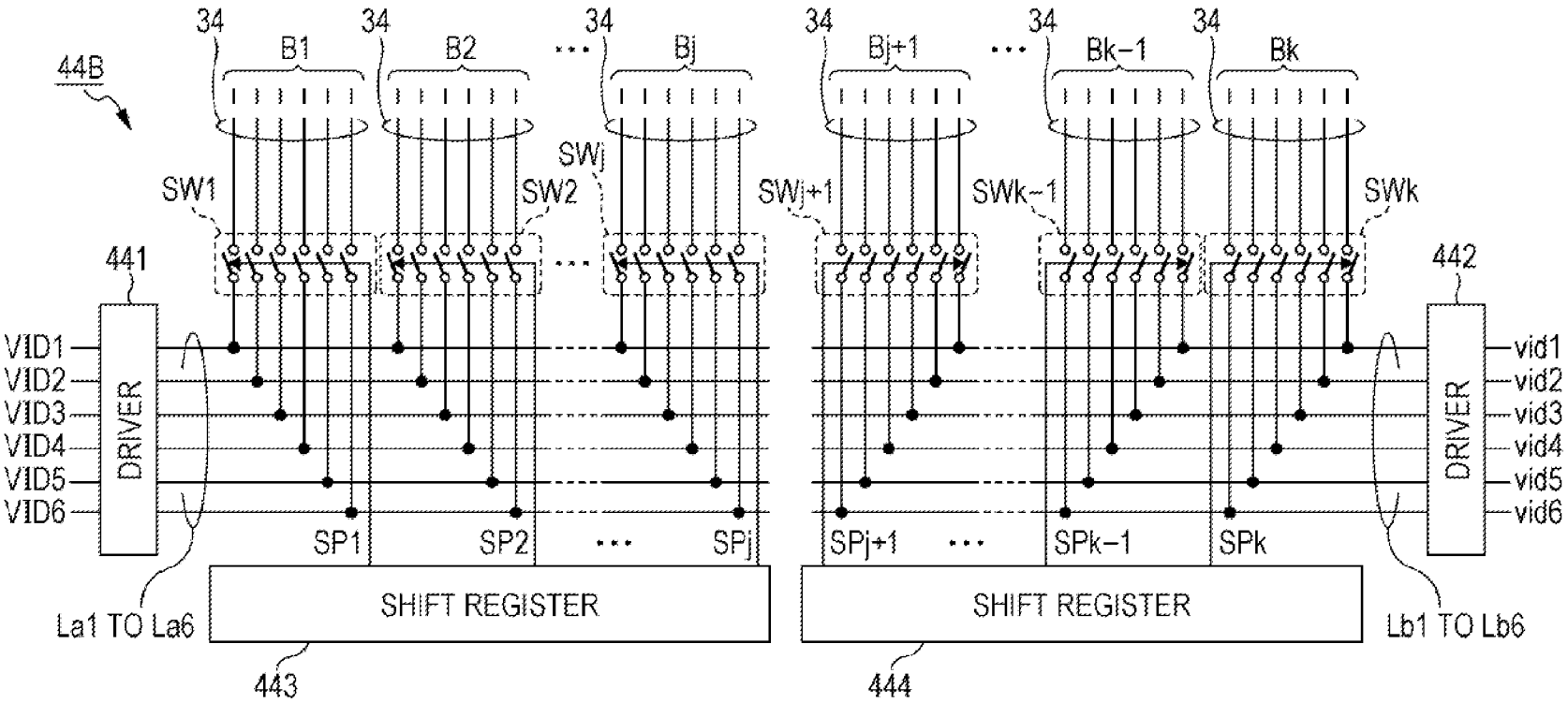
FIG. 16 is a block diagram of a data line drive circuit according to a second embodiment.

FIG. 16 illustrates a configuration of the data line drive circuit 44B. The data line drive circuit 44B includes image signal lines La1 to La6 and Lb1 to Lb6, the driver 441 which supplies the six-phase image signals VID1 to VID6 to the image signal lines La1 to La6, a driver 442 which supplies the six-phase image signals vid1 to vid6 to the image signal lines Lb1 to Lb6, the k(=N/6) switch circuits SW1 to SWk, the shift register 443, and a shift register 444.

The shift register 443 sequentially shifts a shift pulse supplied from the control circuit 14 in accordance with a clock signal and thus generates sampling pulses SP1 to SPj, each of which is exclusively active in the write time Tw. The shift register 444 sequentially shifts a shift pulse supplied from the control circuit 14 in accordance with a clock signal and thus generates sampling pulses SPk to SPj+1 each of which is exclusively active in the write time Tw (J is smaller than K and is natural numbers larger than 1).

Figure 17:
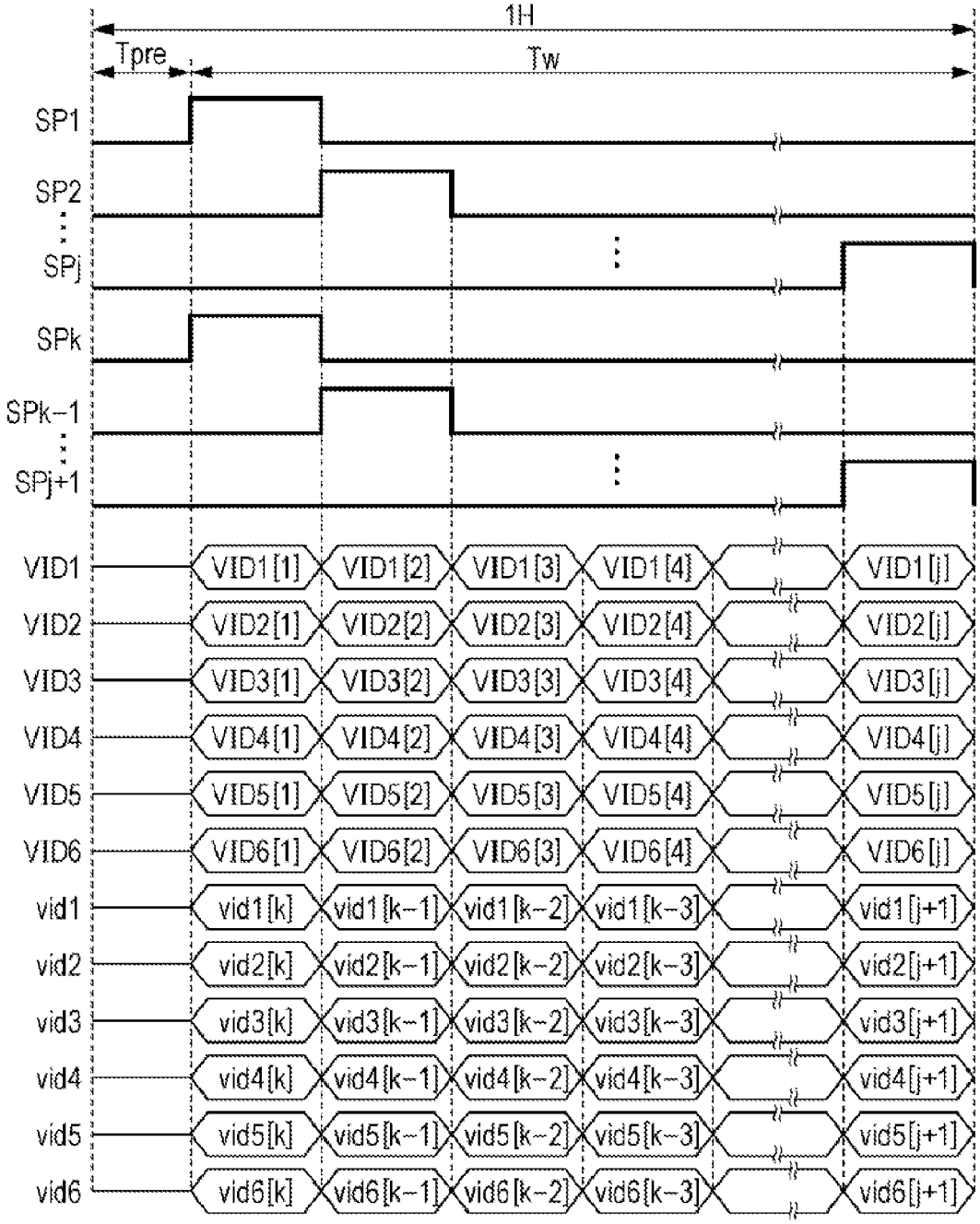
FIG. 17 is a timing chart, illustrating an operation of an electro-optical device according to the embodiment.

FIG. 17 is a timing chart of the data line drive circuit 44B. As is illustrated in this chart, the sampling pulses become active in the following order: SP1 and SPk, SP2 and SPk−1, . . . SPj and SPj+1. Accordingly, the switch circuits are turned on in the following order: SW1 and SWk, SW2 and SWk−1, . . . SWj and SWj+1; whereby the phase-expanded image signals VID1 to VIDE and vid1 to vid6 are supplied to the data lines 34 in the blocks in the following order: B1 and Bk, B2 and Bk−1, . . . Bj and Bj+1.

Figure 18:
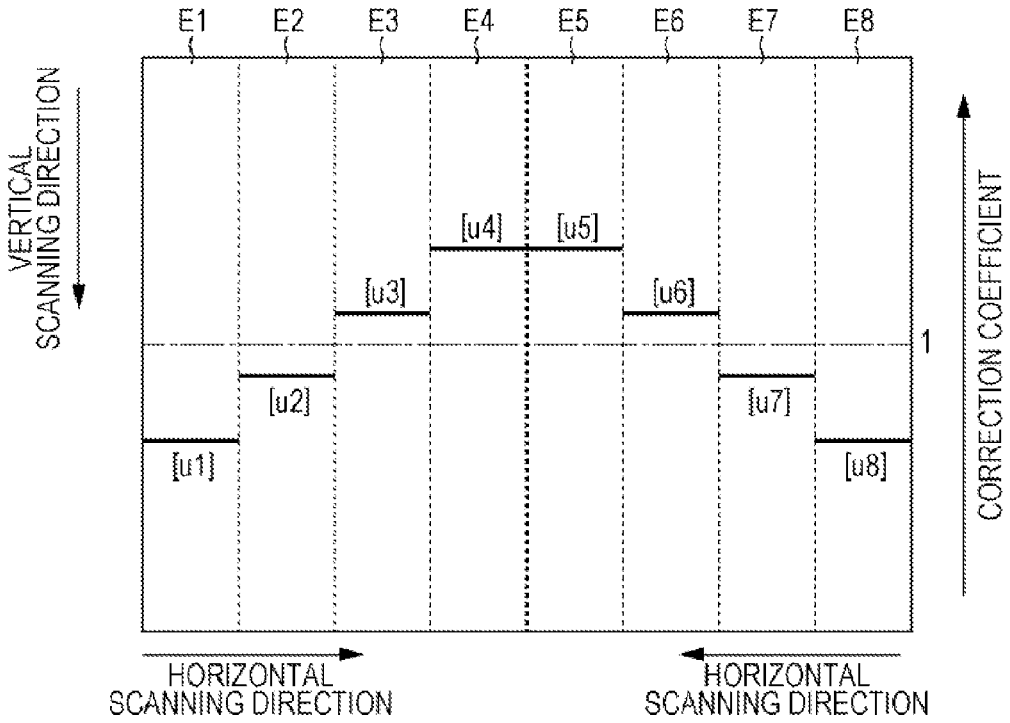
FIG. 18 illustrates another example of a relation between display regions and correction coefficients.

FIG. 18 illustrates an example of a relation between the correction coefficients and the display regions. In this embodiment, the display unit 30 is divided into eight display regions E1 to E8 in the horizontal scanning direction. Correction coefficients u1 to u8 are applied to the display regions E1 to E8, respectively. In this example, the precharge voltage Vpre is higher than a voltage corresponding to a level of gray, as illustrated in FIG. 8. The correction coefficients u1 to u8 satisfy the following formula: u1(=u8)<u2(=u7)<u3(=u6)<u4(=u5).

The data line drive circuit 44B supplies the precharge voltage Vpre to the data line 34 in the precharge time Tpre, then turns on the switch circuits SW1 to SWk sequentially in the above-described order in the write time Tw. The correction coefficient generation unit 142 generates the correction coefficient data C to provide correction coefficients corresponding to the length of time from when the precharge time Tpre ends to when the switches in the switch circuits SW1 to SWk are turned on.

In an example of the related art, a correction coefficient for correction of vertical cross-talk is "1" for all the display regions E1 to E8 as indicated by a single-dot dash line in FIG. 18. Therefore, correction cannot be performed in accordance with an off-leak characteristic of a switch. According to this embodiment, on the other hand, the correction coefficient is changed with the length of off periods of switches; thus, vertical cross-talk can be more accurately reduced.

Modification

The above-described embodiments may be modified in various forms. Specific modifications will be exemplified below. Any two or more modifications selected from the following examples may be combined appropriately, to the extent that they do not contradict each other.

(1) In the above-described embodiments, the display unit 30 is divided into the regions E1 to E8, and the correction coefficient generation unit 142 determines the correction coefficient data C for each region. Here, the number of data lines 34 in each of the regions E1 to E8 is not necessarily the same. The number of display regions is not limited to eight as long as it is two or more.

Alternatively, the data lines 34 may be divided so that the same number of data lines 34 belong to each display region, and a difference between the correction coefficient data C of one display region and the correction coefficient data C of a region next to the display region may be the minimum resolution of the correction coefficient data C. In this case where the number of data lines 34 in each display region is decided so that the difference between neighboring two regions is the minimum resolution of correction coefficient data C, vertical cross-talk can be accurately corrected.

(2) In the above-described embodiments, the correction coefficient generation unit 142 generates the correction coefficient data C in accordance with the length of time from when the precharge time Tpre ends to when the switch is turned on. This is because a change in voltage of the data line 34 due to a leakage current of the switch is decided upon in accordance with that length of time. Specifically, a change in voltage of the data line 34 due to a leakage current of the switch is defined by a change in a difference between the precharge voltage and a voltage of the image signal lines L1 to L6 (or La1 to La6 and Lb1 to Lb6) during a period of time from when the precharge time Tpre ends to when the switch is turned on. Accordingly, the correction coefficient generation unit 142 may generate the correction coefficient data C in accordance with the change in the difference between the precharge voltage Vpre and the voltage of the phase-expanded image signals VID1 to VIDE (and vid1 to vid6) during a period of time from when the precharge time Tpre ends to when the switch is turned on.

(3) In the above-described electro-optical device, the correction coefficient generation unit preferably generates the correction coefficient in accordance with a change in the difference between the precharge voltage and the voltage of the image signals during a period of time from when the precharge time Tpre ends to when the switch is turned on. A change in voltage of the data line is defined by a change in the difference between the voltage of the image signal and the precharge voltage; according to one aspect of the invention, the correction coefficient can be decided upon while taking the precharge voltage into consideration, and thus vertical cross-talk can be sufficiently corrected.

(4) According to one aspect of the invention, an electro-optical element is not limited to a liquid crystal element CL. For example, an organic EL element or an electrophoretic element can be used. In other words, the term "electro-optical element" refers to a display element whose optical characteristic (e.g., transmittance) changes in accordance with an electrical effect (e.g., application of voltage). In the pixel PIX including such an electro-optical element, a change in voltage of the data line 34 may also cause a change in voltage corresponding to the image signal X[*n*] held in the pixel PIX, which results in vertical cross-talk. According to one aspect of this modified example, vertical cross-talk can also be reduced in such a case.

Application

Figure 19:
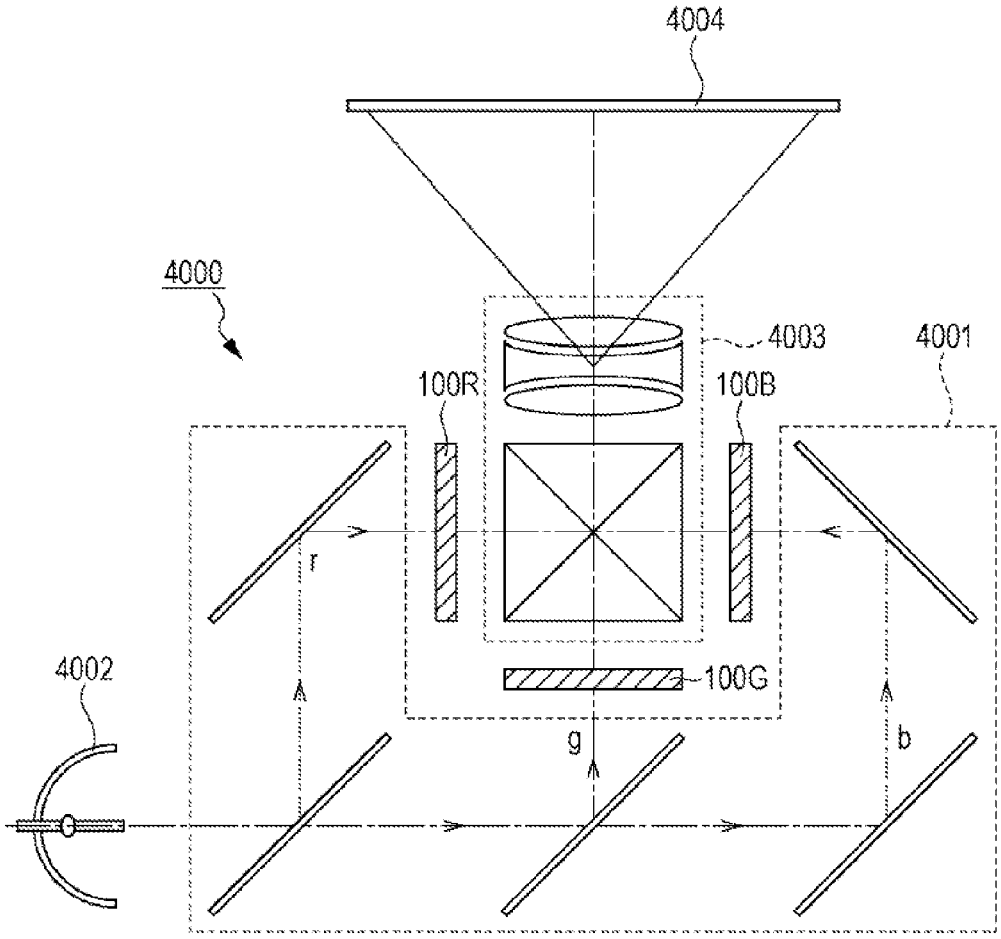
FIG. 19 is a perspective view of an electronic apparatus (a projection display apparatus).
Figure 20:
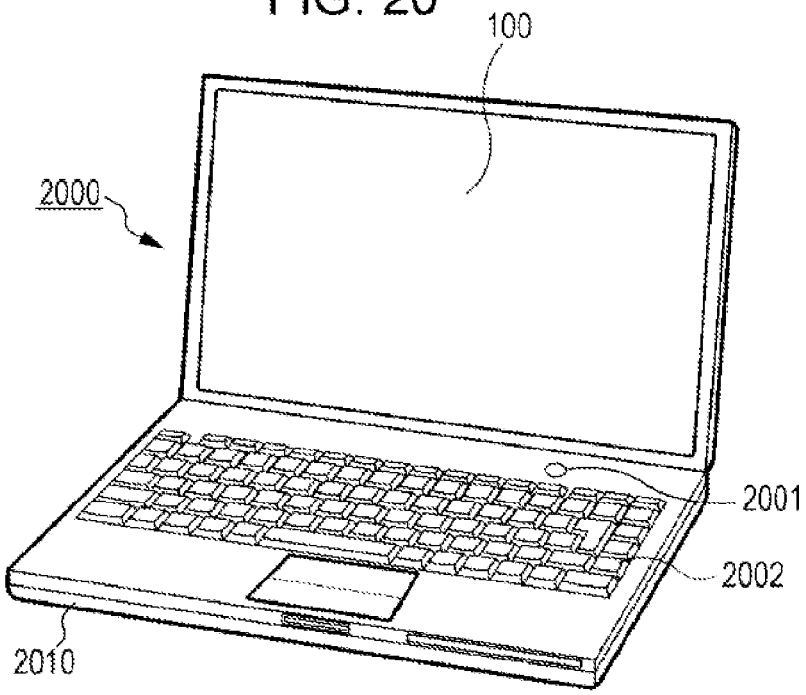
FIG. 20 is a perspective view of an electronic apparatus (a personal computer).
Figure 21:
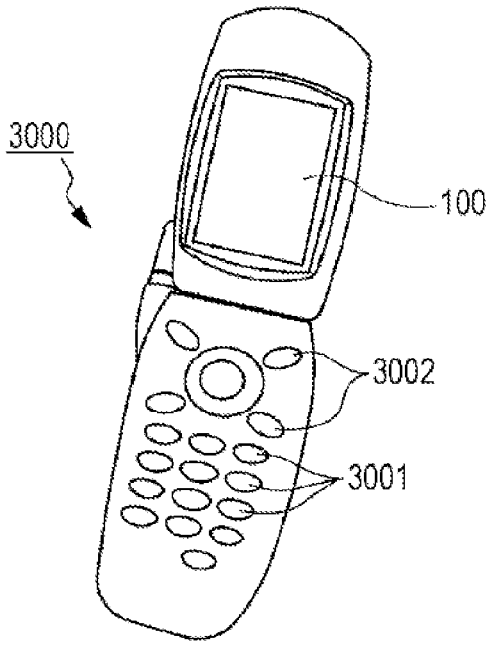
FIG. 21 is a perspective view of an electronic apparatus (a mobile phone).

The electro-optical device 100 according to the above-described embodiments can be used in various electronic apparatuses. In FIGS. 19 to 21, specific electronic apparatuses using the electro-optical device 100 are exemplified.

FIG. 19 is a schematic diagram illustrating a projection display apparatus (a three-plate type projector) 4000 to which the electro-optical device 100 is applied. The projection type display apparatus 4000 includes three electro-optical devices 100 (100R, 100G, and 100B) corresponding to different colors (red, green, and blue). An illumination optical system 4001 supplies a red component r, a green component g, and a blue component b being emitted from an illumination device (a light source) 4002 to the electro-optical devices 100R, 100G, and 100B, respectively. Each electro-optical device 100 serves as an optical modulator (a light valve) which modulates each monochromatic light supplied from the illumination optical system 4001 in accordance with a display image. A projection optical system 4003 synthesizes light emitted from the electro-optical devices 100 and projects the synthesized light onto a projection surface 4004.

FIG. 20 is a perspective view of a portable personal computer using the electro-optical device 100. A personal computer 2000 includes the electro-optical device 100 which displays various images, and a main body 2010 which includes a power switch 2001 and a keyboard 2002.

FIG. 21 is a perspective view of a mobile phone to which the electro-optical device 100 is applied. A mobile phone 3000 includes a plurality of operation buttons 3001, scroll buttons 3002, and the electro-optical device 100 which displays various images. With the scroll buttons 3002, a screen of the electro-optical device 100 is scrolled.

Examples of the electronic apparatus to which the electro-optical device according to one aspect of the invention is applied include a personal digital assistant (PDA), a digital still camera, a television, a video camera, a car navigation apparatus, an in-vehicle display apparatus (an instrument panel), an electronic organizer, an electronic paper, a calculator, a word processor, a workstation, a video phone, a POS terminal, a printer, a scanner, a copy machine, a video player, an apparatus with a touch screen, as well as the apparatuses exemplified in FIGS. 19 to 21.

This application claims priority to Japan Patent Application No. 2013-050099 filed Mar. 13, 2013, the entire disclosures of which are hereby incorporated by reference in their entireties.

What is claimed is:

1. An electro-optical device including a plurality of data lines arranged in a first direction and in which image signals are supplied to pixel circuits via the data lines, the electro-optical device comprising:

a correction amount calculation unit that calculates a correction amount on a basis of input image data and generates correction amount data;

a correction coefficient generation unit that generates correction coefficient data which represents a correction coefficient decided upon in accordance with positions of the data lines in the first direction to which the input image data to be corrected is supplied;

a correction unit that generates correction data on a basis of the correction amount data and the correction coefficient data, corrects the input image data on a basis of the correction data, and generates correction image data;

an image signal generation unit that generates an image signal on a basis of the correction image data;

a plurality of switches that are provided at position corresponding to intersections of image signal lines to which the image signals are supplied and the data lines, and sample the image signals to be provided to the plurality of data lines; and a drive unit that supplies a precharge voltage to the plurality of data lines in a precharge time, and turns on the plurality of switches in a write time after the precharge time in a predetermined order, wherein the plurality of data lines are divided into a plurality of regions such that each region includes a same number of data lines, the correction coefficient generation unit decides upon the correction coefficient data for each of the plurality of regions, and the same number of the data lines in each region is decided upon so that a difference between the correction coefficient data of one of the regions and the correction coefficient data of a region next to the one of the region is a minimum resolution of the correction coefficient data.

2. The electro-optical device according to claim 1, wherein the drive unit sequentially turns on the plurality of switches in the precharge time in one direction, and the correction coefficient generation unit generates the correction coefficient data so that a level of the correction coefficient data changes at a fixed rate in the one direction.

3. The electro-optical device according to claim 1, wherein the correction coefficient generation unit generates the correction coefficient data so that a level of the correction coefficient data corresponds to a length of time from when the precharge time ends to when the plurality of switches are turned on.

4. The electro-optical device according to claim 3, wherein the correction coefficient generation unit generates the correction coefficient in accordance with a change in a difference between a voltage of the image signal and the precharge voltage during a period from when the precharge time ends to when the plurality of switches are turned on.

5. An electronic apparatus comprising the electro-optical device according to claim 1.

* * * * *